US009904238B2

(12) United States Patent
Nagashima et al.

(10) Patent No.: US 9,904,238 B2
(45) Date of Patent: Feb. 27, 2018

(54) IMAGE FORMING APPARATUS INCLUDING TONER CONTAINER, AND TONER CONTAINER

(71) Applicant: KYOCERA Document Solutions Inc., Osaka-shi, Osaka (JP)

(72) Inventors: Teruhiko Nagashima, Osaka (JP); Hidenori Takenaka, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/389,011

(22) Filed: Dec. 22, 2016

(65) Prior Publication Data

US 2017/0357207 A1 Dec. 14, 2017

(30) Foreign Application Priority Data

Jun. 8, 2016 (JP) ..... 2016-114513

(51) Int. Cl.
*G03G 21/16* (2006.01)
*G03G 15/08* (2006.01)

(52) U.S. Cl.
CPC ..... *G03G 21/1652* (2013.01); *G03G 15/0865* (2013.01)

(58) Field of Classification Search
CPC ..... G03G 15/0865
See application file for complete search history.

(56) References Cited

U.S. PATENT DOCUMENTS 8,851,908 B1 * 10/2014 Leiba ..... H01R 12/53 439/92
2003/0180011 A1 * 9/2003 Aronson ..... H01R 23/688 385/92

(Continued)

FOREIGN PATENT DOCUMENTS

EP 2799932 A1 11/2014
JP 2011180598 A 9/2011

OTHER PUBLICATIONS

European Patent Office, Extended European Search Report Issued in European Application No. 16205625.3, dated Jul. 7, 2017, Germany, 7 pages.

*Primary Examiner* — Clayton E LaBalle
*Assistant Examiner* — Jas Sanghera
(74) *Attorney, Agent, or Firm* — Alleman Hall Creasman & Tuttle LLP

(57) ABSTRACT

An image forming apparatus includes a toner container storing toner, and an attachment portion configured to support the toner container in an attachable/detachable manner. The toner container includes a plurality of fixed terminals that are fixed to a facing surface that is a side surface located on one side in an attachment/detachment direction of the toner container with respect to the attachment portion, the facing surface facing the attachment portion when the toner container is attached to the attachment portion. The attachment portion includes a terminal support portion and a plurality of elastic terminals that are provided on the terminal support portion, elastically contact and electrically connect with the fixed terminals respectively, and include a first ground terminal. The elastic terminals project from the terminal support portion toward the facing surface. The first ground terminal is longer than the other elastic terminals in projection length.

10 Claims, 18 Drawing Sheets

(56) References Cited

U.S. PATENT DOCUMENTS

| | | | | |
|---|---|---|---|---|
| 2009/0263164 | A1* | 10/2009 | Koeda | G03G 15/0863 399/262 |
| 2010/0008693 | A1* | 1/2010 | Hayashi | G03G 21/1652 399/90 |
| 2011/0217067 | A1 | 9/2011 | Tokuno et al. | |
| 2011/0236075 | A1* | 9/2011 | Suzuki | G03G 15/0877 399/262 |
| 2015/0118890 | A1 | 4/2015 | Oshikawa | |

* cited by examiner

【FIG. 1】
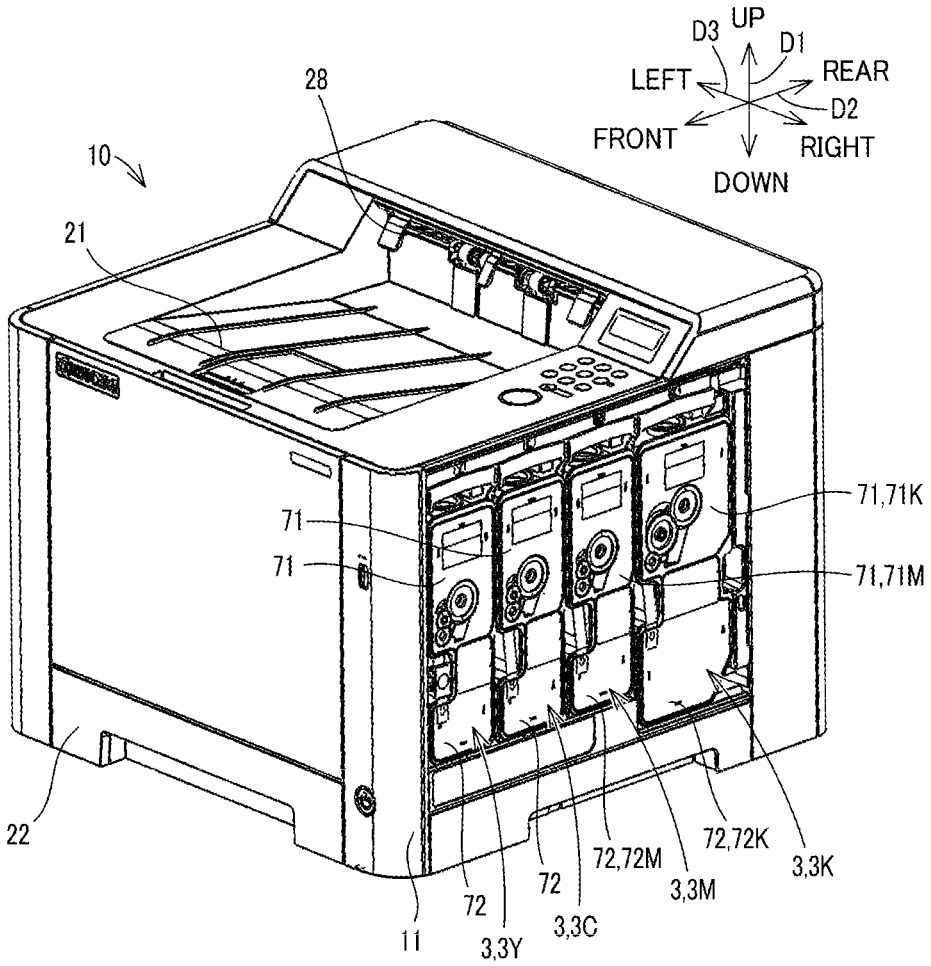

【FIG. 2】
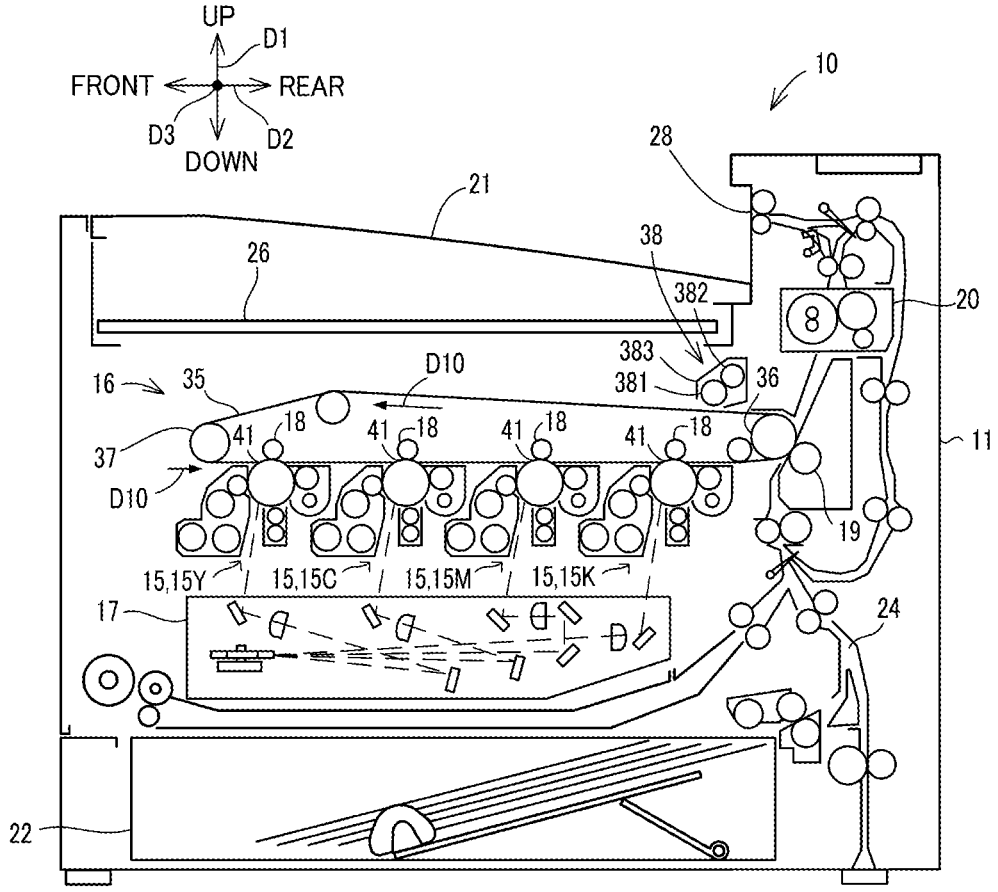

【FIG. 3】
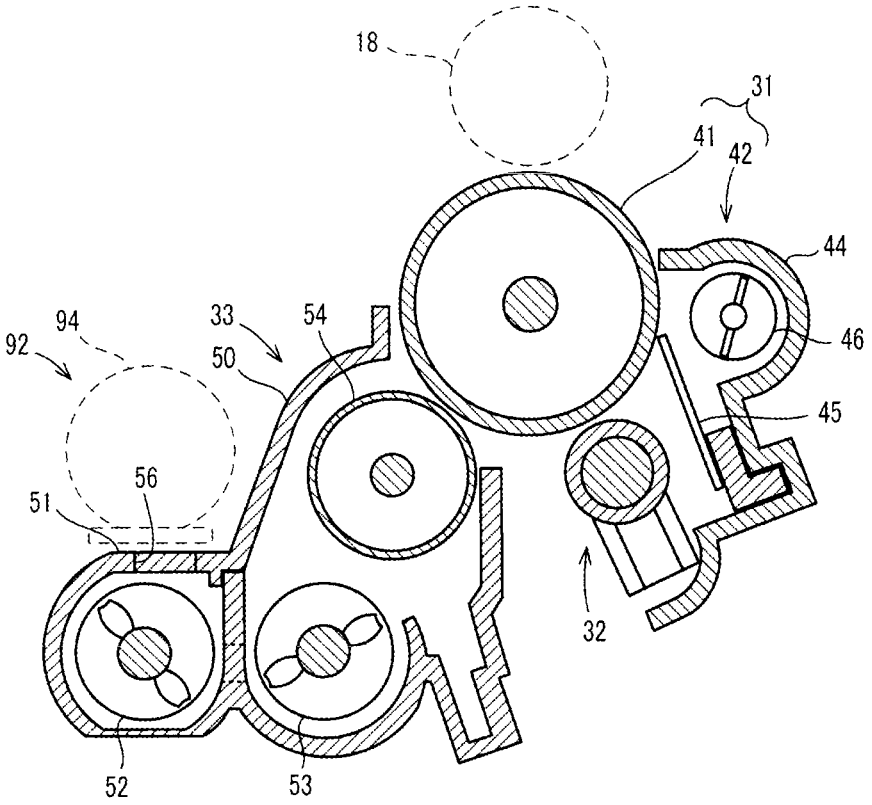

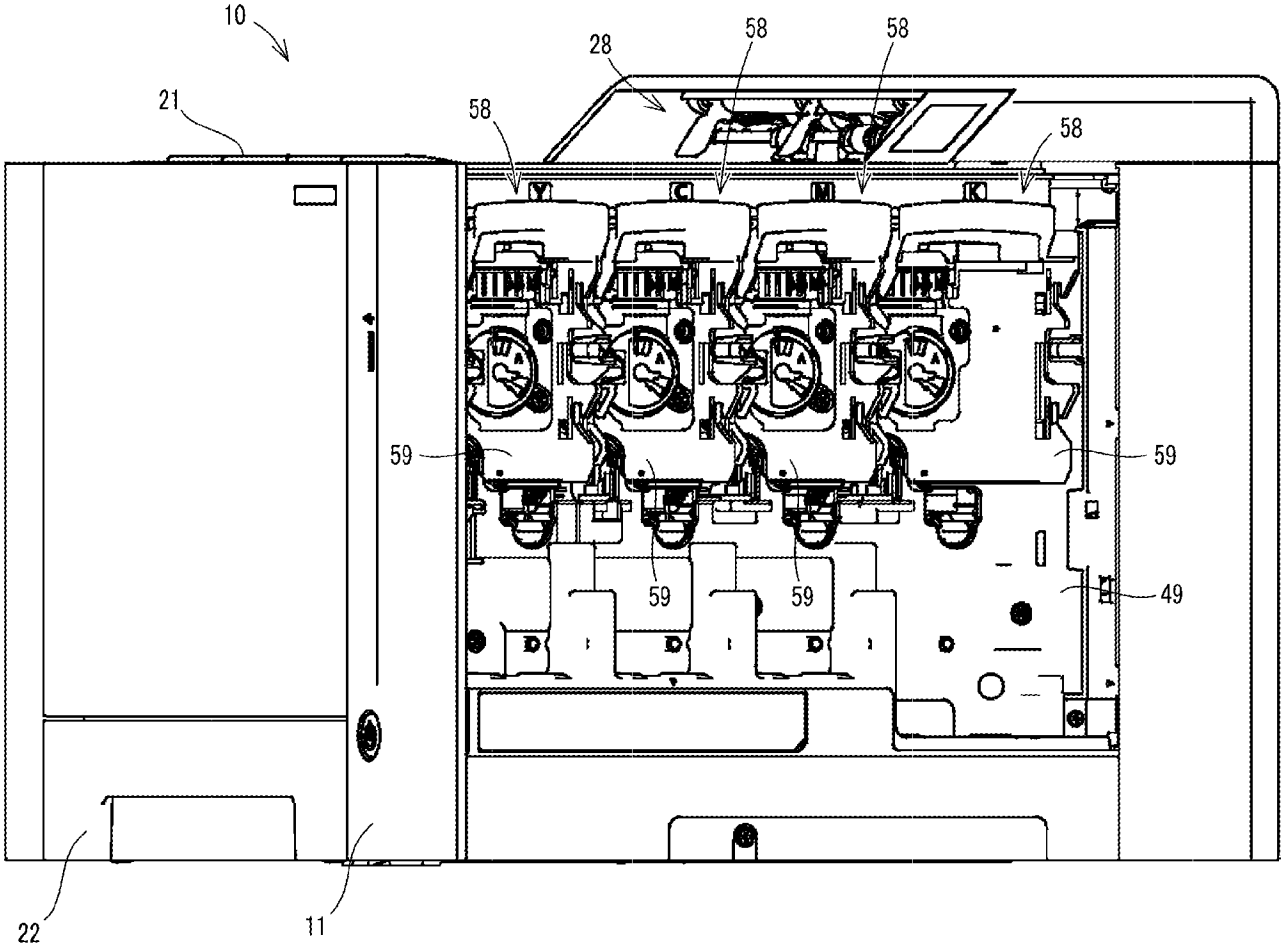
【FIG. 4】

【FIG. 5】
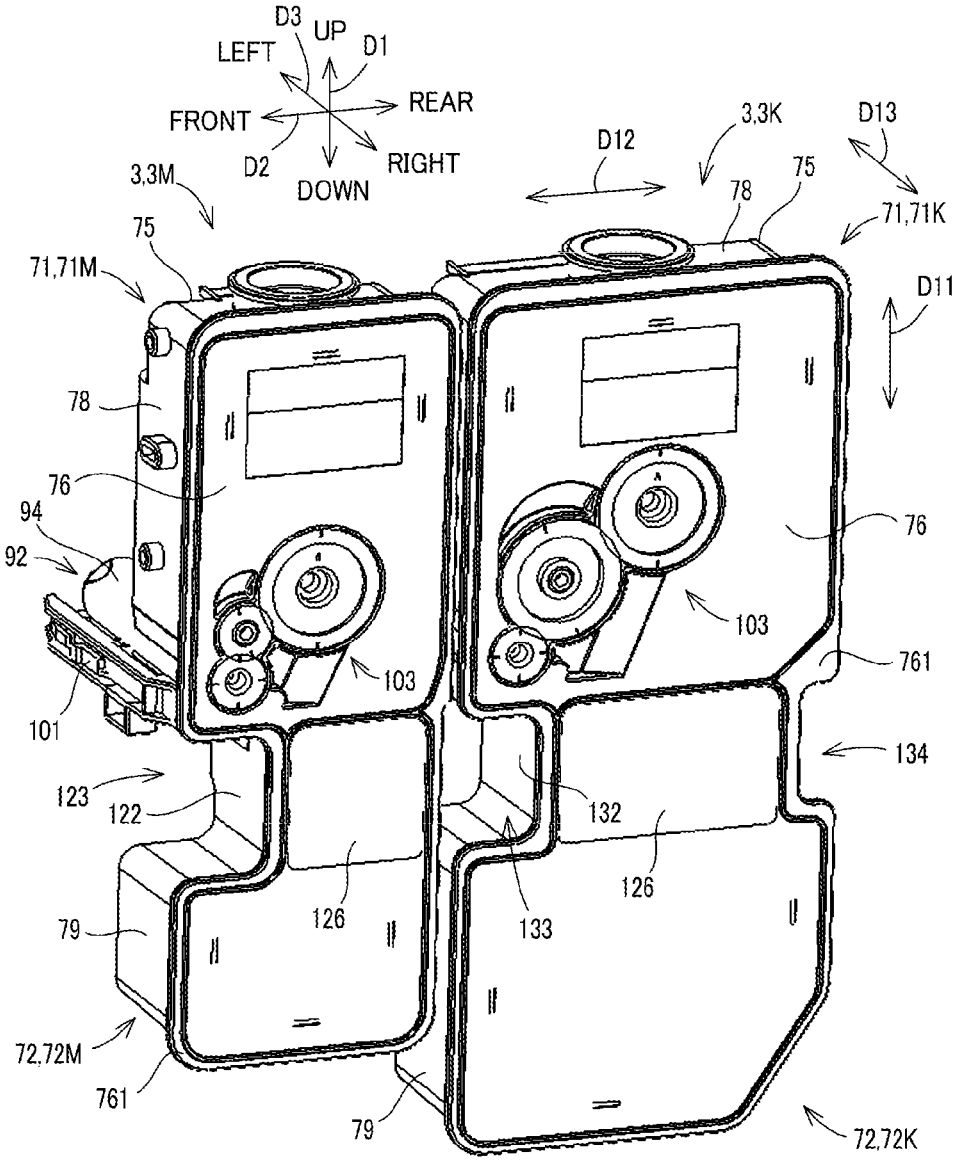

【FIG. 6】
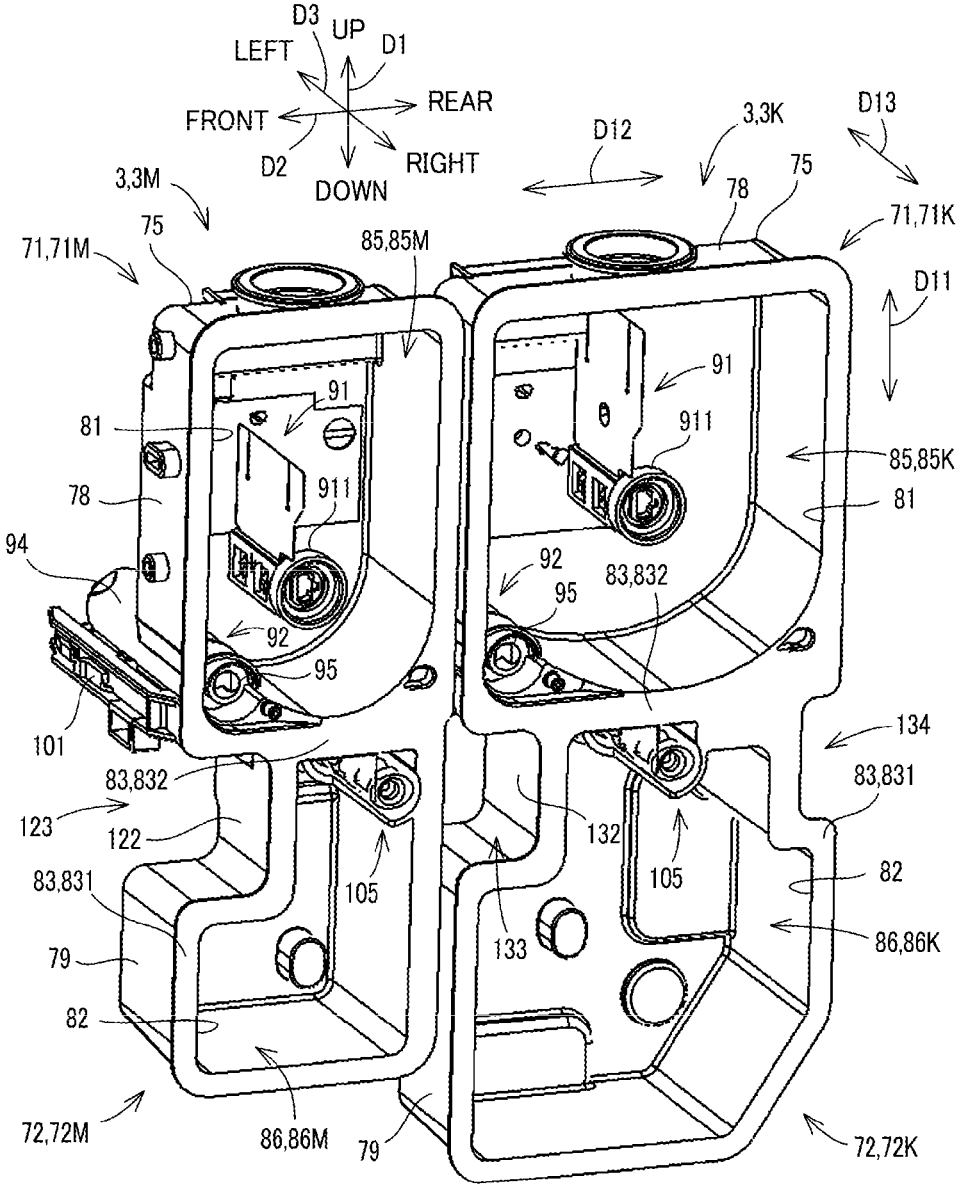

【FIG. 7】
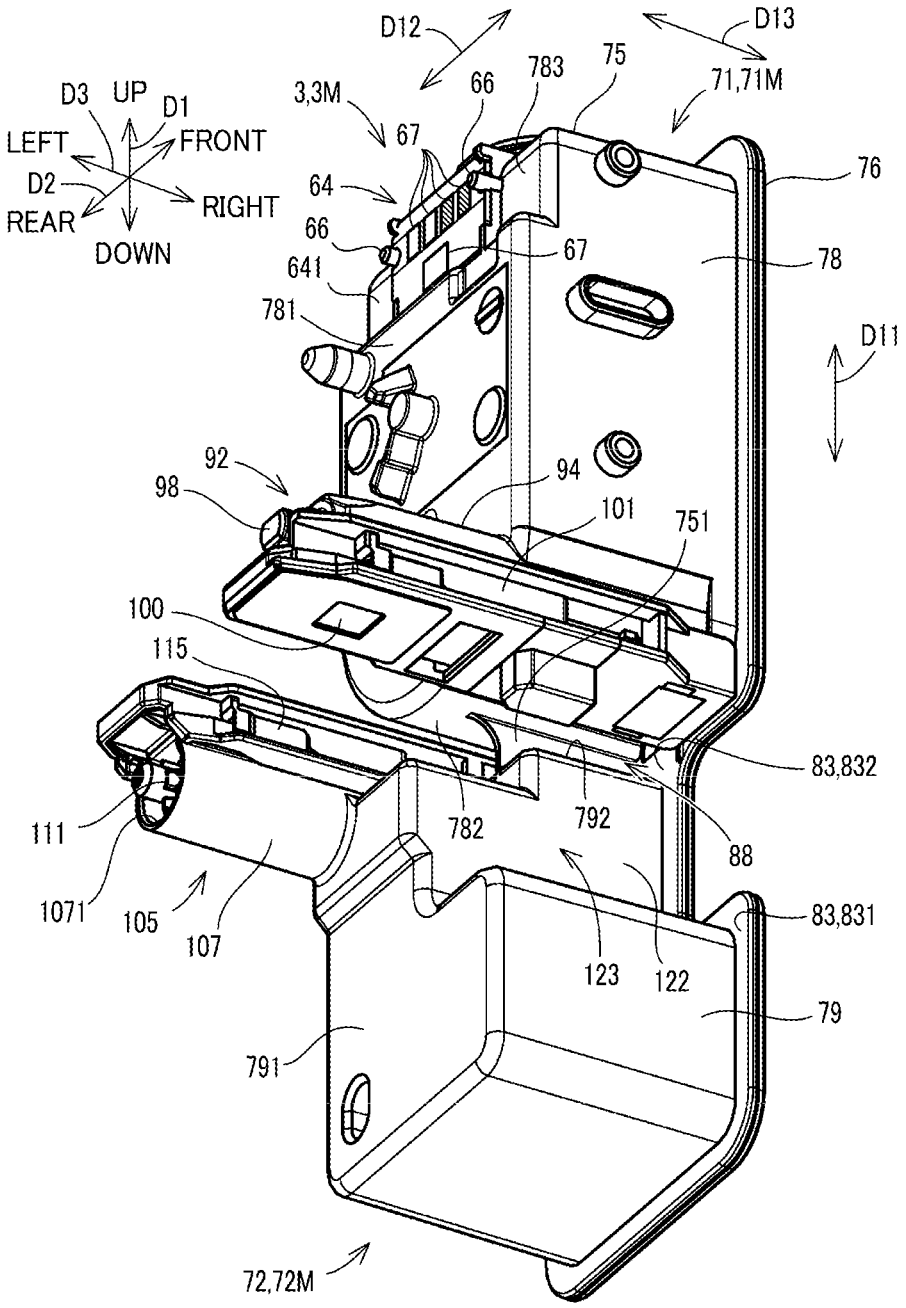

【FIG. 8】
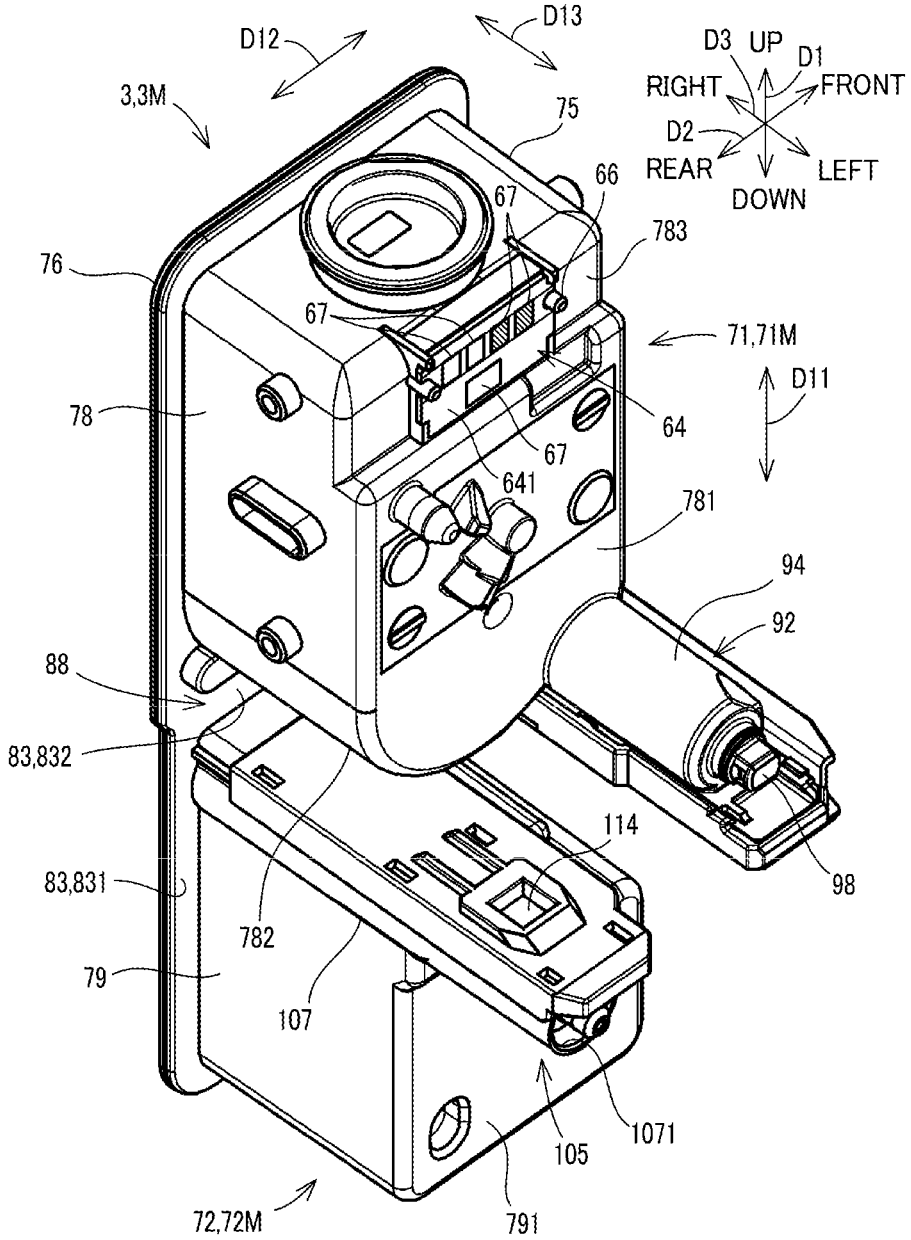

【FIG. 9】
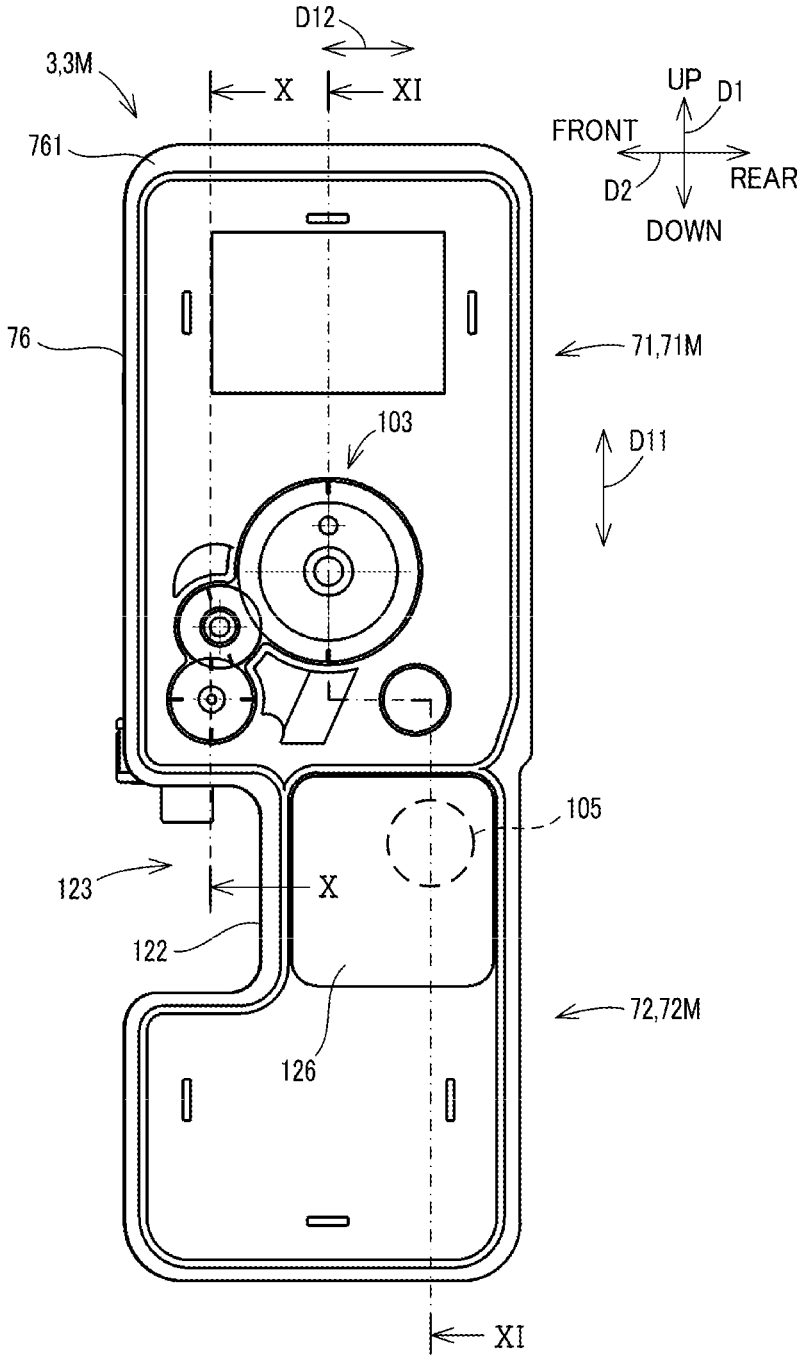

【FIG. 10】
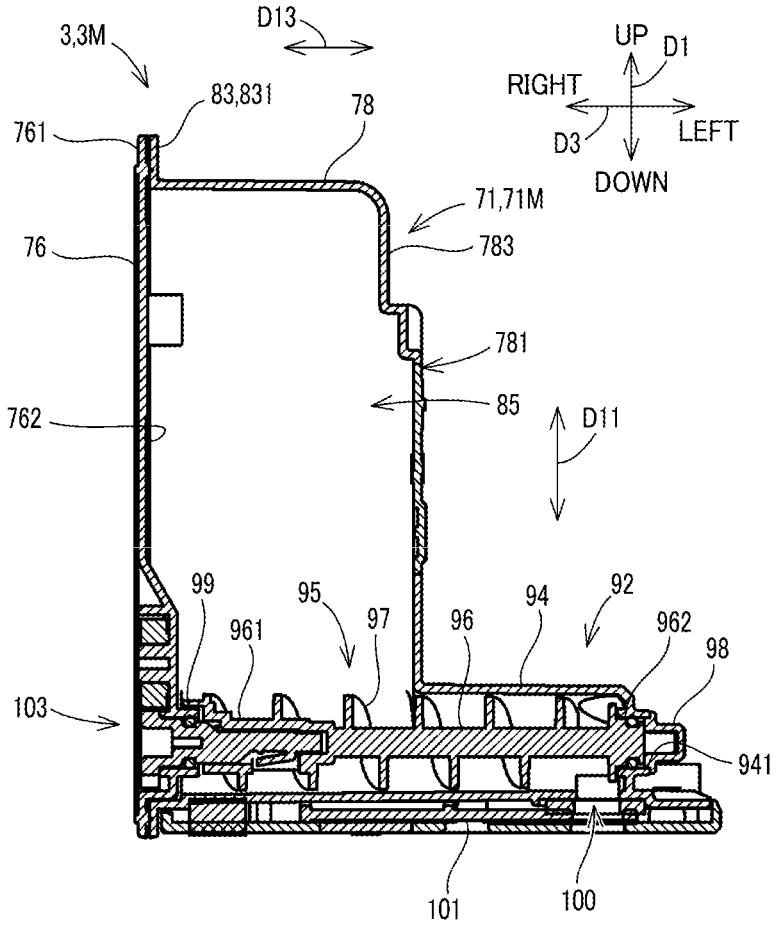

【FIG. 11】
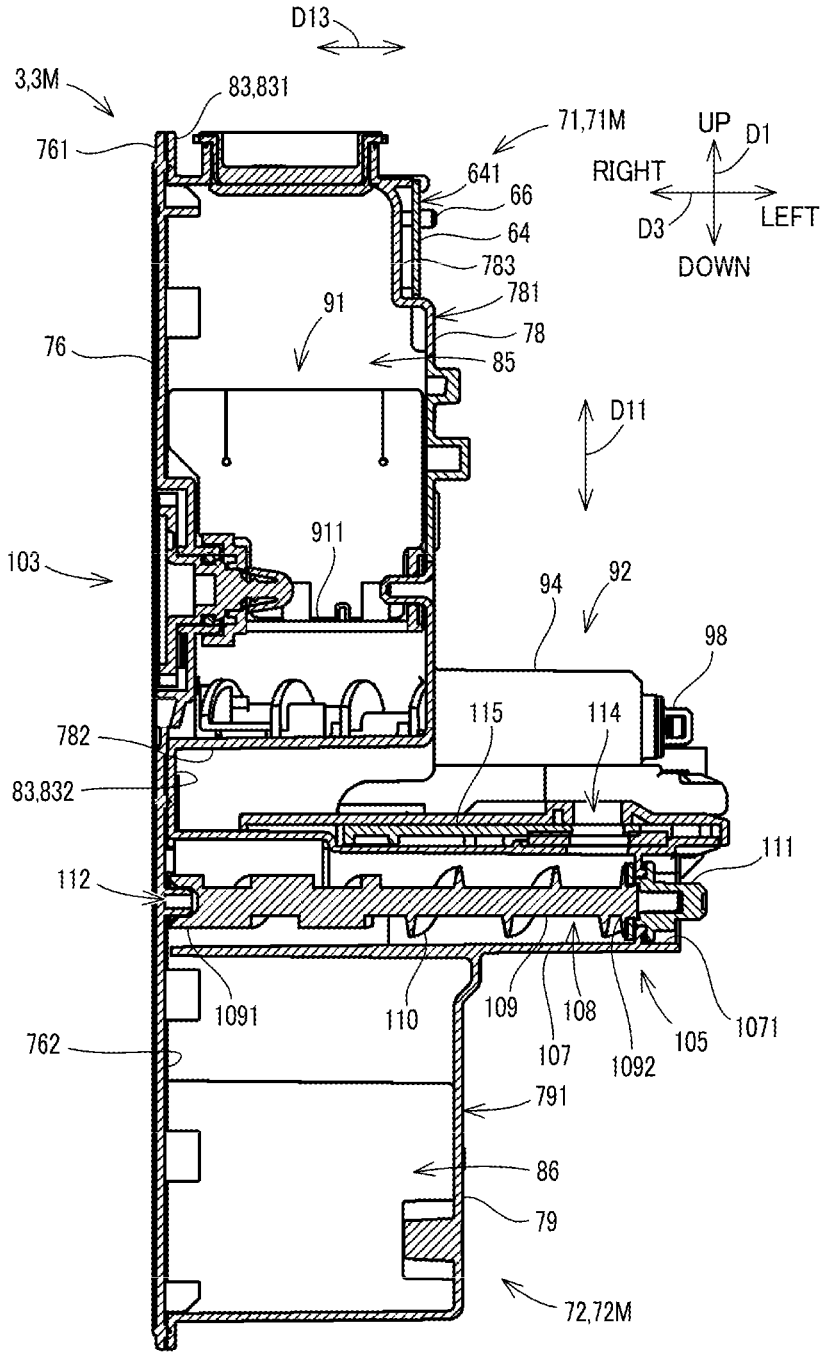

【FIG. 12】
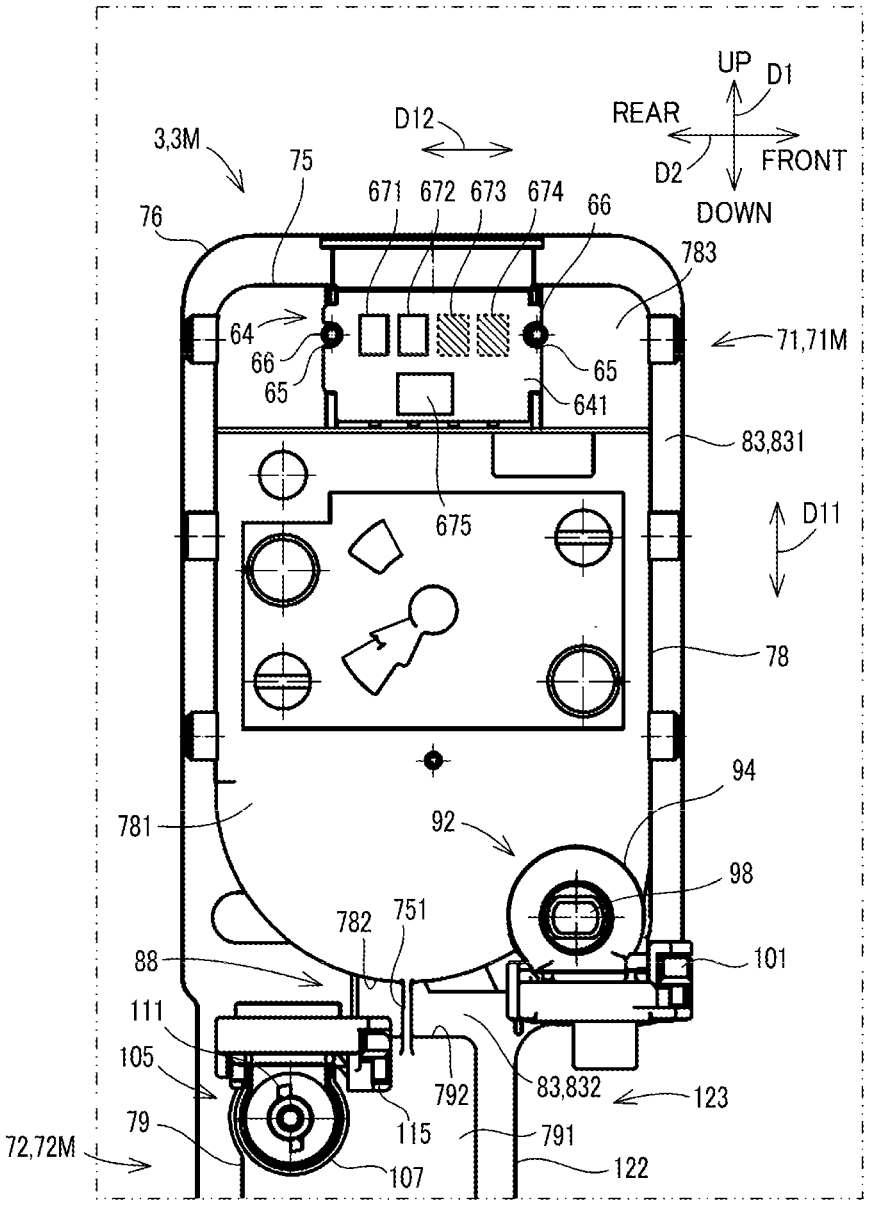

【FIG. 13】
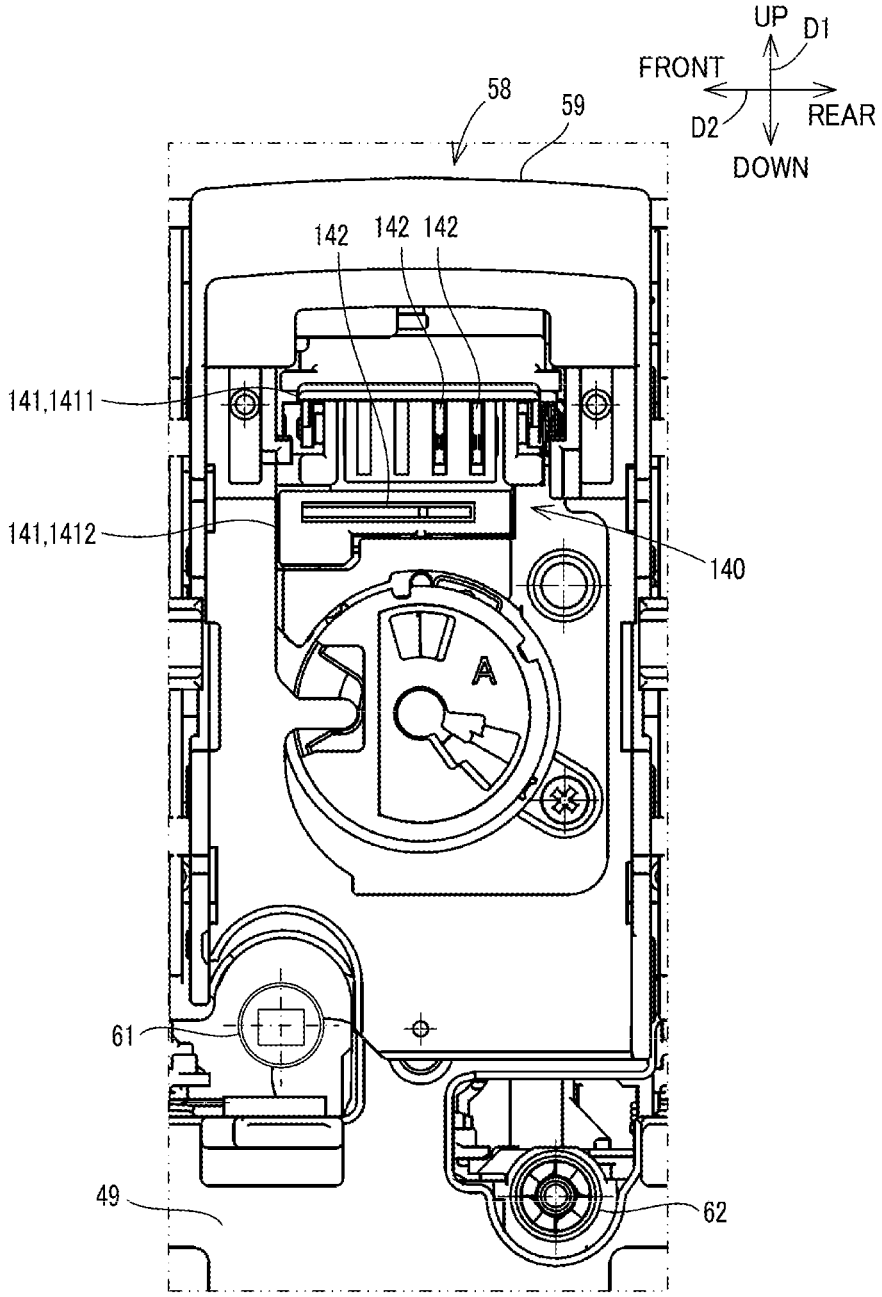

【FIG. 14】
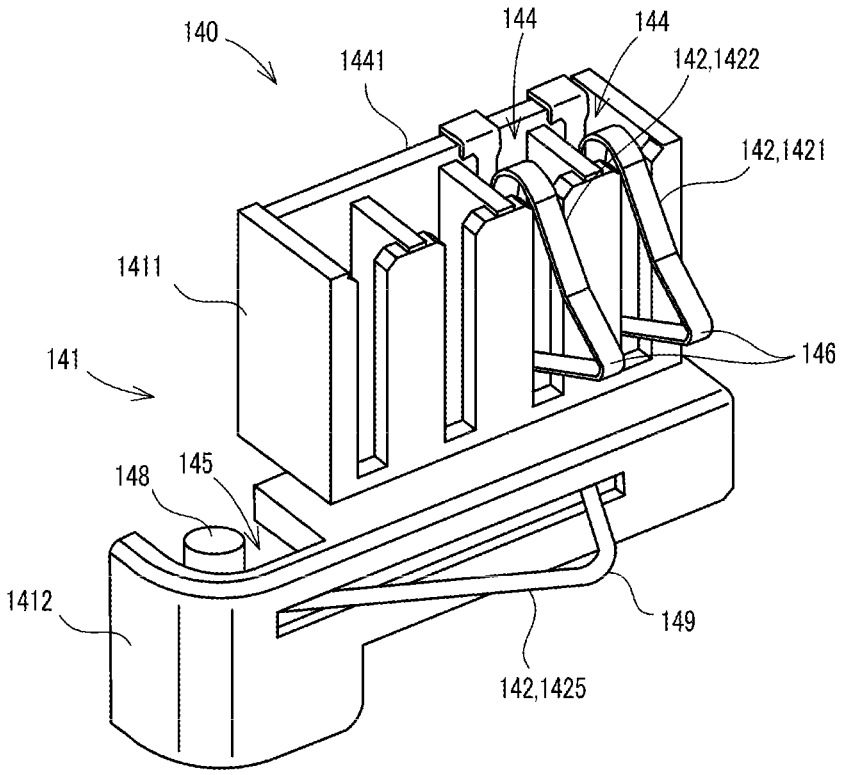

【FIG. 15】
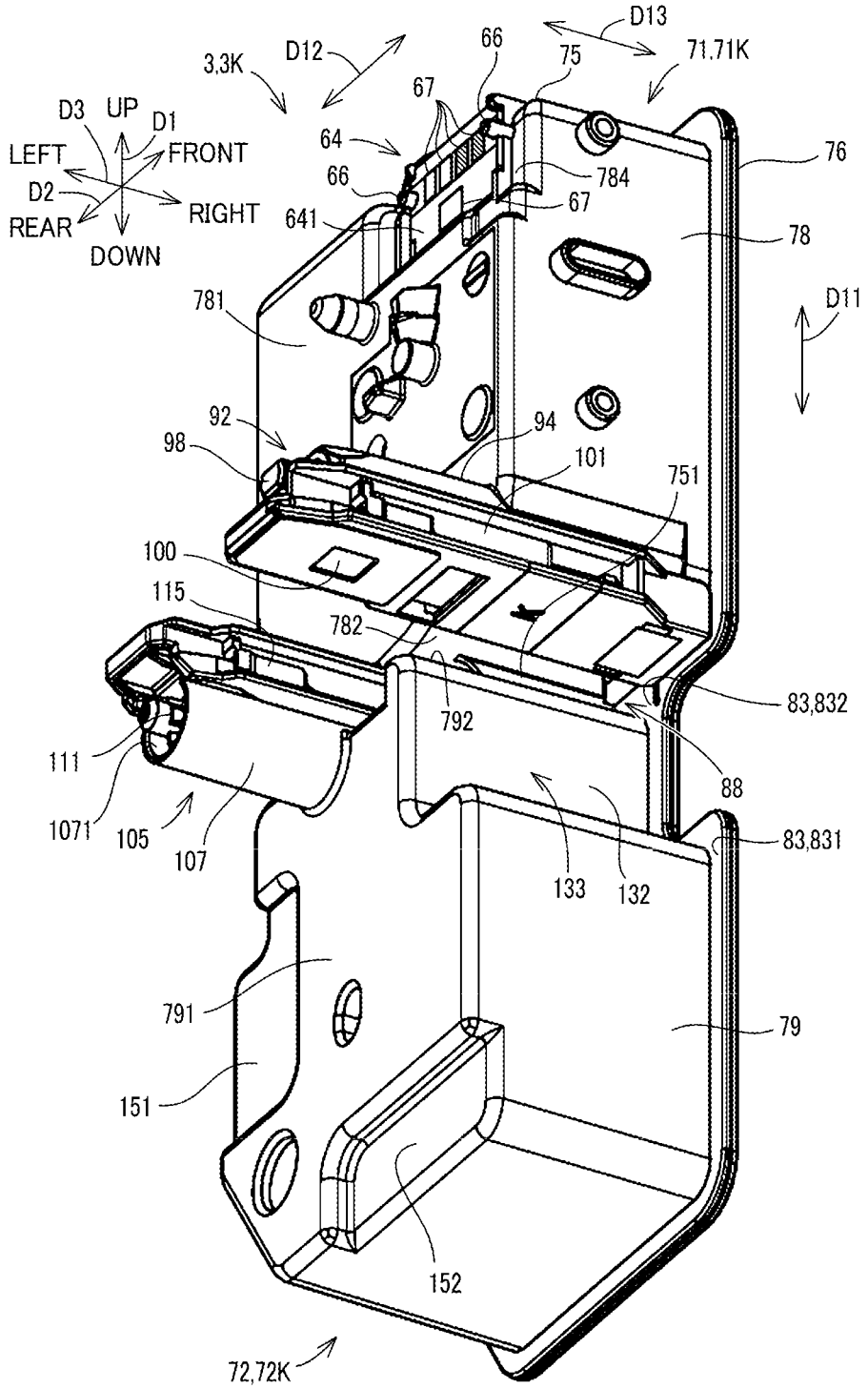

【FIG. 16】
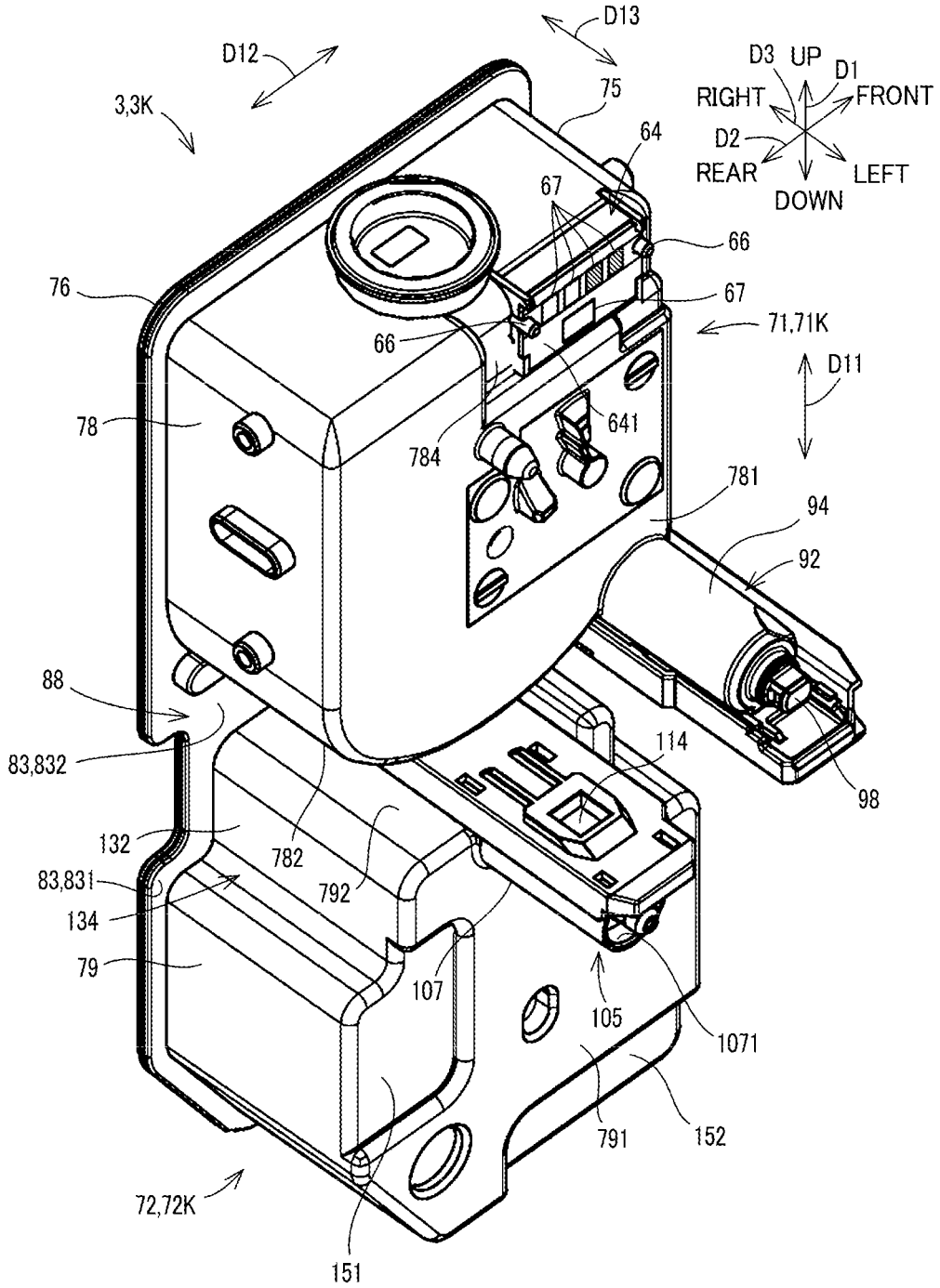

【FIG. 17】
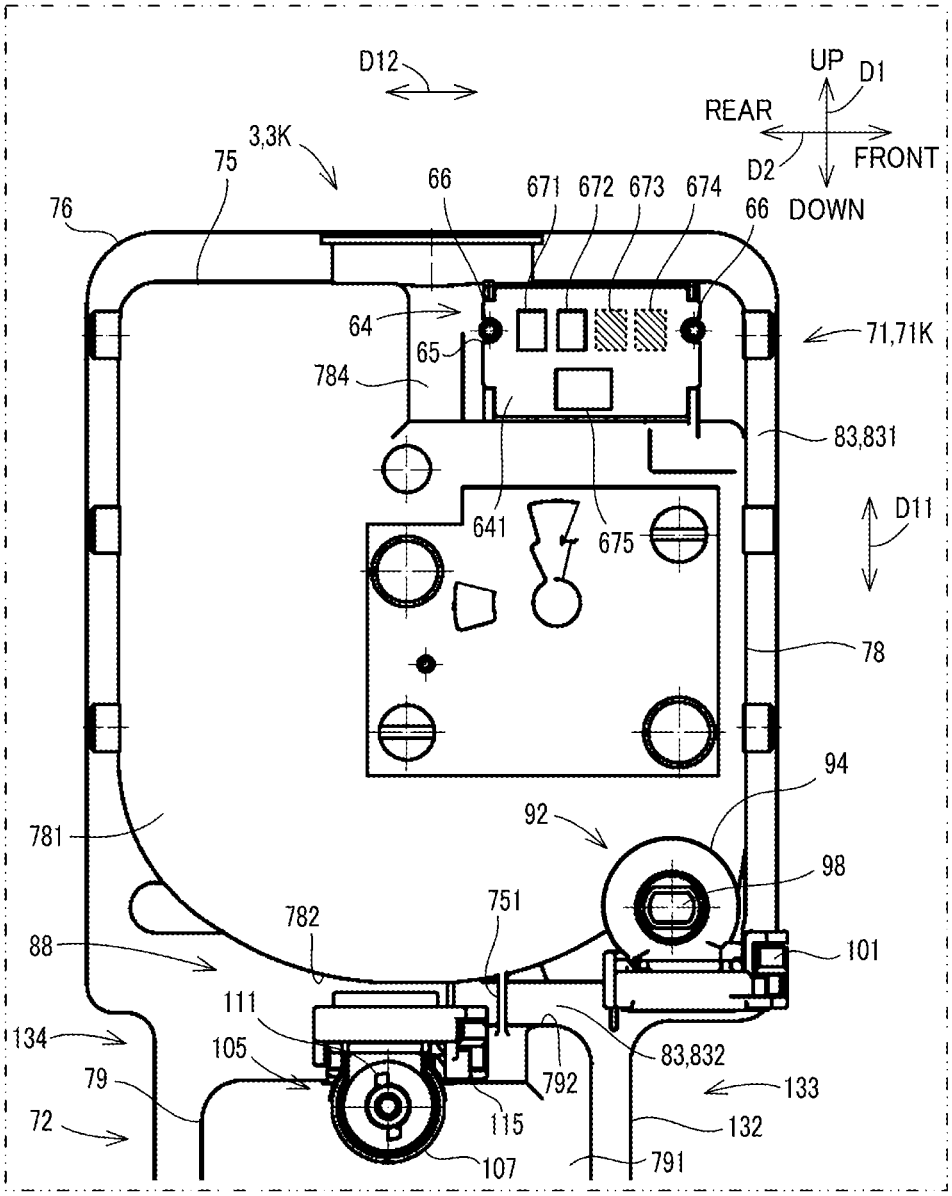

【FIG. 18】
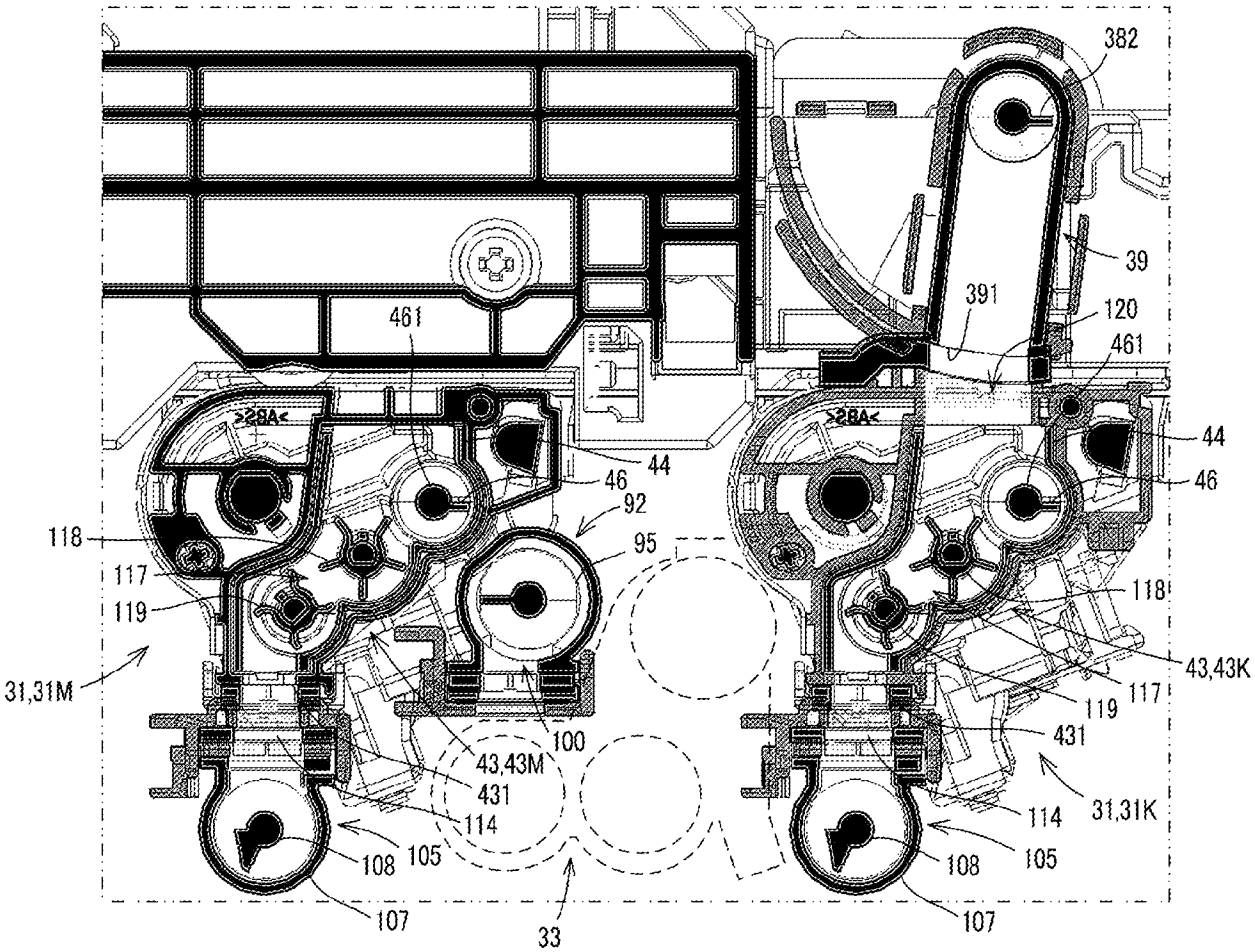

IMAGE FORMING APPARATUS INCLUDING TONER CONTAINER, AND TONER CONTAINER

INCORPORATION BY REFERENCE

This application is based upon and claims the benefit of priority from the corresponding Japanese Patent Application No. 2016-114513 filed on Jun. 8, 2016, the entire contents of which are incorporated herein by reference.

BACKGROUND

The present disclosure relates to an image forming apparatus including a toner container, and a toner container configured to store toner in its inside.

Conventionally, there is known an image forming apparatus that can form an image on a paper sheet by using developer that includes toner. In this type of image forming apparatus, a toner container for supplying toner to a developing device in the image forming apparatus is provided. The toner container is attached to an apparatus main body of the image forming apparatus in a detachable manner. When the toner in the toner container is consumed and the toner container becomes empty, the toner container is removed from the image forming apparatus to be replaced with a new toner container filled with unused toner.

In addition, the conventional image forming apparatus is configured to, when a toner container mounted with an IC chip including memory is attached thereto, connect with the IC chip and read data from the memory of the IC chip.

SUMMARY

An image forming apparatus according to an aspect of the present disclosure includes a toner container and an attachment portion. The toner container stores toner in its inside. The attachment portion supports the toner container in an attachable and detachable manner. The toner container includes a plurality of fixed terminals. The fixed terminals are fixed to a facing surface that is a side surface located on one side in an attachment and detachment direction of the toner container with respect to the attachment portion, the facing surface facing the attachment portion when the toner container is attached to the attachment portion. The attachment portion includes a terminal support portion and a plurality of elastic terminals. The elastic terminals are provided on the terminal support portion, elastically contact and electrically connect with the fixed terminals respectively, and include a first ground terminal. The elastic terminals project from the terminal support portion toward the facing surface. The first ground terminal is longer than the other elastic terminals in projection length.

A toner container according to another aspect of the present disclosure is a toner container supported, in an attachable and detachable manner, by an attachment portion provided in an image forming apparatus. The toner container includes a plurality of fixed terminals. The fixed terminals are fixed to a facing surface that is a side surface located on one side in an attachment and detachment direction of the toner container with respect to the attachment portion, the facing surface facing the attachment portion when the toner container is attached to the attachment portion. The attachment portion includes a terminal support portion and a plurality of elastic terminals. The elastic terminals are provided on the terminal support portion, elastically contact and electrically connect with the fixed terminals respectively, and include a first ground terminal. The elastic terminals project from the terminal support portion toward the facing surface, and the first ground terminal is longer than the other elastic terminals in projection length. During a process in which the toner container is attached to the attachment portion, a first fixed terminal, among the fixed terminals, corresponding to the first ground terminal first contacts the first ground terminal before the other fixed terminals contact.

A toner container according to a further aspect of the present disclosure includes a container main body, a first toner storage portion, a second toner storage portion, and a plurality of fixed terminals. The container main body is elongated. The first toner storage portion stores toner in its inside, and is provided in one side in a longitudinal direction of the container main body. The second toner storage portion stores toner in its inside, and is provided in the other side in the longitudinal direction. The plurality of fixed terminals are provided on a side surface of the first toner storage portion, the side surface being located on one side in a depth direction of the toner container perpendicular to the longitudinal direction. Among the plurality of fixed terminals, a first fixed terminal that is grounded is elongated in a width direction of the container main body perpendicular to the longitudinal direction, and the other fixed terminals are elongated in the longitudinal direction. The first fixed terminal is disposed more on the other side in the longitudinal direction than the other fixed terminals.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 1 is a perspective view showing a configuration of an image forming apparatus according to an embodiment of the present disclosure.

FIG. 2 is a cross section showing a configuration of the image forming apparatus.

FIG. 3 is a cross section schematically showing an internal structure of an image forming unit included in the image forming apparatus.

FIG. 4 is a diagram showing attachment portions to which toner containers are attached.

FIG. 5 is a perspective view showing configurations of toner containers for magenta and black.

FIG. 6 is a perspective view showing internal structures of the toner containers for magenta and black.

FIG. 7 is a perspective view showing a configuration of a rear side of the toner container for magenta.

FIG. 8 is a perspective view showing a configuration of the rear side of the toner container for magenta.

FIG. 9 is a diagram showing a configuration of a front side of the toner container for magenta.

FIG. 10 is a cross section taken along a X-X line of FIG. 9.

FIG. 11 is a cross section taken along an XI-XI line of FIG. 9.

FIG. 12 is a partial enlarged diagram showing a configuration of the rear side of the toner container for magenta.

FIG. 13 is a partial enlarged diagram showing a configuration of an attachment portion to which the toner container for magenta is attached.

FIG. 14 is a perspective view showing a configuration of a terminal unit included in the attachment portion.

FIG. 15 is a perspective view showing a configuration of a rear side of a toner container for black.

FIG. 16 is a perspective view showing a configuration of the rear side of the toner container for black.

FIG. 17 is a partial enlarged diagram showing a configuration of the rear side of the toner container for black.

FIG. 18 is a cross section showing a structure of a right-end portion of the image forming apparatus.

DETAILED DESCRIPTION

The following describes an embodiment of the present disclosure with reference to the drawings. It should be noted that the following embodiment is an example of a specific embodiment of the present disclosure and should not limit the technical scope of the present disclosure. It is noted that, for the sake of explanation, a vertical direction in an installed state of an image forming apparatus 10 where the image forming apparatus 10 is usable (the state shown in FIG. 1) is defined as an up-down direction D1. In addition, a front-rear direction D2 is defined on a supposition that a side to/from which a sheet feed cassette 22 shown in FIG. 1 is inserted and removed in the installed state is a front side. Furthermore, a left-right direction D3 is defined based on the front side of the image forming apparatus 10 in the installed state.

The image forming apparatus 10 according to the present embodiment has at least a print function. The image forming apparatus 10 is, for example, a tandem-type color printer.

As shown in FIG. 1 and FIG. 2, the image forming apparatus 10 includes a housing 11 (an example of the apparatus main body). The housing 11 has an approximately parallelepiped shape as a whole. Some of the components constituting the image forming apparatus 10 are stored in the housing 11. It is noted that FIG. 1 shows a state where a cover covering the right side of the housing 11 has been removed.

As shown in FIG. 2, the image forming apparatus 10 includes a plurality of image forming units 15 (15Y, 15C, 15M, and 15K), an intermediate transfer unit 16, a laser scanning device 17, a primary transfer roller 18, a secondary transfer roller 19, a fixing device 20, a sheet tray 21, the sheet feed cassette 22, a conveyance path 24, and a control board 26 configured to control the portions of the image forming apparatus 10. In addition, the image forming apparatus 10 includes toner containers 3 (see FIG. 1) that have been attached to the inside of the housing 11 in a detachable manner. In the present embodiment, the image forming apparatus 10 includes four image forming units 15.

FIG. 3 is a cross-sectional view of a central portion of an image forming unit 15. The image forming unit 15 forms a toner image by the electrophotography. As shown in FIG. 3, each of the image forming units 15 includes a drum unit 31, a charging device 32, and a developing device 33.

As shown in FIG. 2, the image forming units 15 are arranged in alignment along the front-rear direction D2 in the housing 11, and form a color image based on the so-called tandem system. Specifically, the image forming unit 15Y is configured to form a toner image of yellow. In addition, the image forming units 15C, 15M and 15K are configured to form toner images of cyan, magenta and black, respectively. The image forming units 15Y for yellow, 15C for cyan, 15M for magenta, and 15K for black are arranged in alignment in the stated order from the downstream side in the running direction (the direction indicated by the arrow D10) of a transfer belt 35 of the intermediate transfer unit 16.

The drum unit 31 includes a photoconductor drum 41, a drum cleaning device 42 (an example of the drum cleaning portion), a discharge guide portion 43 (see FIG. 18), and a housing 44 that supports these components. The housing 44 is elongated in the left-right direction D3. The photoconductor drum 41 has a cylindrical shape and carries a toner image developed by the developing device 33. The photoconductor drum 41 is rotatably supported by the housing 44.

In each of the image forming units 15, the charging device 32 uniformly charges the photoconductor drum 41 to a certain potential. Subsequently, the laser scanning device 17 irradiates a laser beam on the surface of the photoconductor drum 41 based on the image data. In this processing, electrostatic latent images are formed on the surfaces of the photoconductor drums 41, respectively. The electrostatic latent images are developed (visualized) as toner images by the developing devices 33, respectively. The toner images of respective colors formed on the surfaces of the photoconductor drums 41 are transferred to the transfer belt 35 by the primary transfer roller 18 such that the toner images are overlaid with each other in sequence. Next, the color image on the transfer belt 35 is transferred by the secondary transfer roller 19 to a print sheet. The color image transferred to the print sheet is fixed to the print sheet by the fixing device 20, and thereafter, the print sheet is discharged from a sheet discharge port 28 to the sheet tray 21.

The drum cleaning device 42 is configured to remove toner that has remained on the photoconductor drum 41 after the transfer. The drum cleaning device 42 is disposed on the rear side of the photoconductor drum 41. The drum cleaning device 42 is provided for each photoconductor drum 41. The drum cleaning device 42 includes a cleaning blade 45 that is a cleaning member, and a spiral member 46. The cleaning blade 45 and the spiral member 46 are elongated in the left-right direction D3. The cleaning blade 45 and the spiral member 46 are supported by the housing 44. The cleaning blade 45 has approximately the same length as the photoconductor drum 41. The tip of the cleaning blade 45 is disposed so as to be in contact with or close to the surface of the photoconductor drum 41. The spiral member 46 is a toner conveyance member having a spiral blade around a shaft. The spiral member 46 is rotatably supported in the housing 44.

The spiral member 46 is rotated when a rotational driving force is input to its shaft. While the photoconductor drum 41 is rotated, the cleaning blade 45 removes toner that has remained on the surface of the photoconductor drum 41 after the transfer by the primary transfer roller 18. The removed toner is to be discarded later, and thus called waste toner in general. The waste toner is conveyed toward a certain direction by the rotating spiral member 46. Specifically, the waste toner is conveyed toward one side (in the present embodiment, the right side) in the axis direction (longitudinal direction) of the photoconductor drum 41.

As shown in FIG. 18, the discharge guide portion 43 is disposed at the right end of the housing 44. The waste toner is guided downward by the discharge guide portion 43, passes through a discharge port 431 (see FIG. 18) that is described below, and is discharged to a lower storage portion 72 of the toner container 3. It is noted that the discharge guide portion 43 is described below.

As shown in FIG. 3, the developing device 33 includes a housing 50, a first stirring member 52, a second stirring member 53, and a developing roller 54. Toner (developer) is stored in a bottom portion of the housing 50 and the toner is conveyed while being stirred by the first stirring member 52 and the second stirring member 53. A supply port 56 is formed in a wall 51 of the housing 50 that is located above the first stirring member 52. The supply port 56 is formed at the right end of the wall 51. The toner discharged from the toner container 3 is supplied from the supply port 56 into the housing 50. The developing roller 54 draws up the toner from the second stirring member 53 by the magnetic pole embedded therein, and carries the toner on its circumferential surface. The toner held on the developing roller 54 is caused to adhere to the electrostatic latent image on the photoconductor drum 41 by the potential difference applied to between the developing roller 54 and the photoconductor drum 41.

As shown in FIG. 1, a plurality of toner containers 3 (3Y, 3C, 3M and 3K) are attached to the inside of the housing 11. Specifically, the four toner containers 3 are respectively attached to attachment portions 58 (see FIG. 4) provided in the inside of the housing 11. In addition, in the present embodiment, a plurality of toner containers 3 are attached in a state of being aligned along the front-rear direction D2, and a toner container 3K for black is disposed at the rear-most position.

Each of the toner containers 3 includes an upper storage portion 71 (an example of the first toner storage portion) and a lower storage portion 72 (an example of the second toner storage portion). The upper storage portion 71 includes, inside thereof, a storage space 85 (see FIG. 6) for storing toner, and unused toner for supply is stored in the storage space 85. The lower storage portion 72 includes, inside thereof, a storage space 86 (see FIG. 6) for storing toner, and the waste toner discharged from the drum cleaning device 42 is stored in the storage space 86. In the state where the toner containers 3 are respectively attached to the attachment portions 58, the unused toner is supplied to the insides of the developing devices 33 from the upper storage portions 71 of the toner containers 3. In addition, waste toner discharged from the drum cleaning devices 42 passes through the discharge guide portions 43 (see FIG. 18), and is stored in the lower storage portions 72 of the toner containers 3. As shown in FIG. 1, in the present embodiment, the four toner containers 3 are located at the right side of the image forming units 15 inside a right-side cover (not shown) of the housing 11. The toner containers 3 are arranged on the right side of the housing 11 in alignment along the front-rear direction D2. The toner containers 3 are described in detail below.

As shown in FIG. 2, the intermediate transfer unit 16 is provided above the four image forming units 15. More specifically, the intermediate transfer unit 16 is provided above the photoconductor drums 41. The intermediate transfer unit 16 includes the transfer belt 35, a driving roller 36, a driven roller 37, a belt cleaning device 38 (an example of the belt cleaning portion), and a relay guide portion 39 (see FIG. 18). It is noted that the primary transfer roller 18 is supported by a frame (not shown) of the intermediate transfer unit 16.

The transfer belt 5, an annular belt member, is suspended between the driving roller 36 and the driven roller 37 so as to extend in the front-rear direction D2. A plurality of drum units 31 are arranged in alignment in the front-rear direction D2 along the transfer belt 35. The transfer belt 35 holds, on its surface, toner images primarily transferred from the photoconductor drums 41. When the transfer belt 35 is rotationally driven and moves in a direction indicated by the arrow D10, the toner images of respective colors carried by the photoconductor drums 41 are transferred to the transfer belt 35 such that the toner images are overlaid with each other in sequence.

The belt cleaning device 38 is disposed in the vicinity of the fixing device 20. Specifically, the belt cleaning device 38 is provided above the transfer belt 35 in the rear side of the housing 11. Below the belt cleaning device 38, the image forming unit 15K, which is an image forming unit 4 for black, is disposed. That is, the belt cleaning device 38 is located closest to the image forming unit 15K for black among the plurality of image forming units 4.

The belt cleaning device 38 is configured to remove the waste toner that has remained on the surface of the transfer belt 35, and convey the removed waste toner toward the lower storage portion 72 of the toner container 3K. The belt cleaning device 38 includes a cleaning roller 381 that is elongated in the left-right direction D3, a spiral member 382 as a conveyance member for conveying the waste toner, and a housing 383 for storing these components (see FIG. 2). The cleaning roller 381 is configured to remove the waste toner from the surface of the transfer belt 35 by rotating while in contact with the surface of the transfer belt 35. The used toner thus removed (hereinafter referred to as "waste toner") is conveyed in a certain direction by the spiral member 382 as it rotates. Specifically, the waste toner is conveyed toward one side in the width direction (a direction that matches the left-right direction D3) of the transfer belt 35 (in the present embodiment, conveyed toward the right side).

As shown in FIG. 18, the relay guide portion 39 is provided at the right end of the housing 383. The waste toner is guided downward by the relay guide portion 39, passes through a discharge guide portion 43K of a drum unit 31K disposed at the rear-most position, and is conveyed to the lower storage portion 72 of the toner container 3K. It is noted that the relay guide portion 39 is described below.

FIG. 18 is a partial enlarged diagram showing a cross-sectional structure of a right-end portion of the drum units 31 of the image forming units 15. FIG. 18 shows cross-sectional structures of the drum unit 31M for magenta and the drum unit 31K for black. For the sake of explanation, in FIG. 18, a developing device 33 corresponding to the drum unit 31K is represented by a dotted line. As shown in FIG. 18, a discharge guide portion 43M is provided at the right end of the housing 44 of the drum unit 31M. That is, the discharge guide portion 43M is provided in the drum unit 31M. It is noted that a discharge guide portion 43 having the same structure as the discharge guide portion 43M is provided in each of the drum units 31 for yellow and cyan.

The discharge guide portion 43M guides the waste toner that has been removed by the drum cleaning device 42 in the drum unit 31M and conveyed to the right end of the housing 44, to an inlet 114 of the lower storage portion 72 of the toner container 3M. An inner space of the discharge guide portion 43M is a passage 117 in which the waste toner passes. The discharge guide portion 43M extends diagonally downward from above, and the discharge port 431 connected to the inlet 114 is formed at a lower end of the discharge guide portion 43M.

In the passage 117, a right end portion 461 of the spiral member 46 is disposed. The end portion 461 is rotatably supported by the discharge guide portion 43M. When a rotational driving force is transmitted to the end portion 461, the spiral member 46 rotates, and the waste toner is conveyed to the passage 117 of the discharge guide portion 43M.

In the passage 117, two paddle portions 118 and 119 are provided in a region from the end portion 461 to the discharge port 431. The rotation shaft of each of the paddle portions 118 and 119 is rotatably supported by the discharge guide portion 43M. The rotational driving force of the spiral member 46 is transmitted to the paddle portions 118 and 119 via a gear transmission mechanism (not shown). When the spiral member 46 is rotated, its rotational driving force is transmitted to the paddle portions 118 and 119 via the gear transmission mechanism, and the paddle portions 118 and 119 are rotated. When the paddle portions 118 and 119 rotate, the waste toner that has been conveyed to the passage 117 is conveyed in the passage 117 to the discharge port 431 by the paddle portions 118 and 119, is further passed through the inlet 114 and a first conveyance guide portion 94 (an example of the first guide portion) of the toner container 3M, and guided into the lower storage portion 72 of the toner container 3M.

As shown in FIG. 18, a discharge guide portion 43K is provided at the right end of the housing 44 of the drum unit 31K. That is, the discharge guide portion 43K is provided in the drum unit 31K. The discharge guide portion 43K guides the waste toner that has been removed by the drum cleaning device 42 in the drum unit 31K and conveyed to the right end of the housing 44, to the inlet 114 of the lower storage portion 72 of the toner container 3K. The discharge guide portion 43K and the discharge guide portion 43M have some components in common. As a result, the components common to these portions are assigned the same reference signs, and description thereof is omitted.

The discharge guide portion 43K differs from the discharge guide portion 43M in that a receiving port 120 is formed at the top of the discharge guide portion 43K. The receiving port 120 is an opening from which the waste toner discharged from the belt cleaning device 38 is received. The receiving port 120 is connected to a discharge port 391 of the relay guide portion 39 that is described below. The waste toner that has entered the receiving port 120 is guided to the inlet 114 of the lower storage portion 72 of the toner container 3K by the discharge guide portion 43K, together with the waste toner discharged from the drum cleaning device 42.

As shown in FIG. 18, the relay guide portion 39 is provided at the right end of the belt cleaning device 38. The relay guide portion 39 guides the waste toner that has been conveyed to the right end of the housing 383 through the belt cleaning device 38 by the spiral member 382, to the discharge guide portion 43K. The discharge port 391 is formed in a lower portion of the relay guide portion 39, and the discharge port 391 is connected to the receiving port 120 of the discharge guide portion 43K. With this configuration, the waste toner discharged from the belt cleaning device 38 passes through the relay guide portion 39 and moves downward, and is guided through the discharge port 391 to the receiving port 120. The waste toner guided to the receiving port 120 passes through the discharge guide portion 43K, is conveyed further downward by the paddle portions 118 and 119, passes through the discharge port 431, the inlet 114, and a second conveyance guide portion 107 (an example of the second guide portion) of the toner container 3K, and is guided into the lower storage portion 72 of the toner container 3K.

As shown in FIG. 4, four attachment portions 58 for supporting the toner containers 3 in a detachable manner are provided at the right end of the housing 11. The attachment portions 58 are fixed to a support plate 49 provided at the right end of the housing 11. Each attachment portion 58 includes a bracket 59 for supporting a corresponding toner container 3. The toner containers 3 are supported by corresponding brackets 59 in a detachable manner.

In the following, the configuration of the toner container 3M for magenta is described. FIG. 5 and FIG. 6 show the toner container 3M and the toner container 3K disposed next to the toner container 3M.

The toner containers 3Y and 3C have the same configuration as the toner container 3M, thus description thereof is omitted. The toner container 3K is larger in outer shape and capacity than the toner container 3M since the toner container 3K stores black toner that is used much, but except for the differences described below, they have approximately the same configuration. As a result, components of the toner container 3K that are the same as those of the toner container 3M are assigned the same reference signs, and description thereof is omitted.

It is noted that the drawings show the up-down direction D1, the front-rear direction D2 and the left-right direction D3 based on an attachment attitude of the toner containers 3M and 3K attached to the attachment portions 58 (see FIG. 4). In the following, with respect to the toner containers 3M and 3K in the attachment attitude, the up-down direction D1 is defined as a height direction D11 of the toner containers 3M and 3K, the front-rear direction D2 is defined as a width direction D12 of the toner containers 3M and 3K, and the left-right direction D3 is defined as a depth direction D13 of the toner containers 3M and 3K.

As shown in FIG. 5 and FIG. 6, the toner container 3M includes a container main body 75. The container main body 75 is a resin product formed by injection molding a synthetic resin. The container main body 75 is elongated in the height direction D11, broad in the width direction D12, and shallow in the depth direction D13.

The container main body 75 includes an upper case 78 (an example of the first housing) formed in the upper side thereof, a lower case 79 (an example of the second housing) formed in the lower side thereof, and a lid member 76 (an example of the lid member). That is, the upper case 78 is formed in one side (upper side) of the container main body 75 in the height direction D11 (longitudinal direction), and the lower case 79 is formed in the other side (lower side) of the container main body 75 in the height direction D11 (longitudinal direction). The upper case 78 and the lower case 79 are integrally formed as the container main body 75. In the upper case 78, the storage space 85 for storing the unused toner is defined. That is, the storage space 85 in the upper storage portion 71 is defined by the upper case 78. In addition, in the lower case 79, the storage space 86 for storing the waste toner is defined. That is, the storage space 86 in the lower storage portion 72 is defined by the lower case 79.

The upper case 78 and the lower case 79 are separated from each other in the up-down direction D1, and a gap 88 (see FIG. 7) having a predetermined distance is formed between the upper case 78 and the lower case 79. Specifically, as shown in FIG. 7 and FIG. 12, the upper case 78 includes a bottom wall 782 that constitutes the bottom wall surface thereof and is formed in an arc shape, and the lower case 79 includes a top wall 792 that constitutes the top wall surface thereof. The gap 88 is formed between the bottom wall 782 and the top wall 792. Here, the bottom wall 782 and the top wall 792 are an example of the pair of walls that are separated from each other in the height direction D11.

An opening portion 81 is formed in the right side surface of the upper case 78, and an opening portion 82 is formed in the right side surface of the lower case 79. The opening portions 81 and 82 are formed on the same plane. A flange 83 is formed along opening edges of the opening portions 81 and 82. The flange 83 is formed in the shape of a plate having a thickness in the depth direction D13. The flange 83 includes a peripheral flange 831 and a central flange 832 (an example of the coupling member and the common flange). The peripheral flange 831 is formed around the outer periphery of the right side surface of the container main body 75. The central flange 832 is, as shown in FIG. 12, formed at a position corresponding to the gap 88 so as to couple the bottom wall 782 of the upper case 78 with the top wall 792 of the lower case 79. More specifically, the central flange 832 is continued from the lower edge of the opening portion 81 to the upper edge of the opening portion 82. In other words, the central flange 832 is a flange common to the opening portion 81 and the opening portion 82. In the present embodiment, the bottom wall 782 and the top wall 792 extend from the central flange 832 in the depth direction D13.

The lid member 76 is a resin product formed by injection molding a synthetic resin. As shown in FIG. 5, the lid member 76 covers the opening portion 81 and the opening portion 82. The lid member 76 is a flat plate-like member and is formed in the shape that matches the peripheral shape of the flange 83. In a state where an outer periphery 761 of the lid member 76 is aligned with the flange 83, the outer periphery 761 and the flange 83 are welded.

With the opening portion 81 and the opening portion 82 being closed by one lid member 76, the upper storage portion 71 having the storage space 85 and the lower storage portion 72 having the storage space 86 are provided. In this way, since the upper storage portion 71 and the lower storage portion 72 are coupled with each other by the central flange 832 and the lid member 76, in the toner container 3M, a portion around the gap 88 is smaller in strength than the other portions. As a result, the toner container 3M can be easily bent at the vicinity of the gap 88 in the width direction D12 and in the depth direction D13, and can be easily bent in the rotation direction around the height direction D11 as the axis of rotation.

As shown in FIG. 7 and FIG. 12, a plate-like reinforcing rib 751 is disposed between the bottom wall 782 of the upper case 78 and the top wall 792 of the lower case 79. The reinforcing rib 751 extends in the depth direction D13 vertically from the central flange 832. As shown in FIG. 12, the reinforcing rib 751, coupled with the bottom wall 782 and the top wall 792, is a plate-like member having a thickness in the width direction D12. As shown in FIG. 7, the left-end surface of the reinforcing rib 751 is inclined diagonally upward left from the top wall 792 to the bottom wall 782, and more specifically, inclined in a curved shape. With the provision of the reinforcing rib 751 as such, the strength at the vicinity of the gap 88 between the upper storage portion 71 and the lower storage portion 72 is reinforced. As a result, the toner container 3M is prevented from being excessively bent at the vicinity of the gap 88, in particular, prevented from being excessively bent in the depth direction D13.

As shown in FIG. 8 and FIG. 11, the lower storage portion 72 of the toner container 3M is larger in size in the depth direction D13 than the upper storage portion 71. That is, the size in the depth direction D13 of the lower storage portion 72 of the toner container 3M is larger than that of the upper storage portion 71. In addition, the size in the height direction D11 of the upper storage portion 71 is larger than that of the lower storage portion 72, and the upper storage portion 71 and the lower storage portion 72 have approximately the same size in the width direction D12. In the configuration where the upper storage portion 71 and the lower storage portion 72 are separate in the up-down direction D1, there may be a case where each of the upper storage portion 71 and the lower storage portion 72 cannot secure an enough capacity for storing toner. However, with the above-described configuration where the upper storage portion 71 and the lower storage portion 72 have different sizes in the height direction D11 and the depth direction D13, it is possible to secure an enough capacity for each of the upper storage portion 71 and the lower storage portion 72 in spite of various constraints in the attachment to the attachment portion 58.

As shown in FIG. 6, the upper storage portion 71 includes a stirring member 91 (an example of the third rotating member) and a first conveyance portion 92. Specifically, a paddle-like stirring member 91 is provided in the upper storage space 85. The stirring member 91 is supported by the upper case 78 so as to be rotatable in the storage space 85. In addition, the first conveyance portion 92 for conveying toner to the developing device 33 is provided in the storage space 85.

As shown in FIG. 7 and FIG. 8, the first conveyance portion 92 includes a first conveyance guide portion 94 and a spiral member 95, wherein the first conveyance guide portion 94 is cylindrical and extends outward from a wall surface 781 (an example of the facing surface) of the left side of the upper case 78, and the spiral member 95 (an example of the first rotating member, see FIG. 10) is provided in the inside of the first conveyance guide portion 94. The first conveyance guide portion 94 is integrally formed with the upper case 78 in the shape of a cylinder whose center is the same as the rotation center of the spiral member 95. Here, the wall surface 781 is located in one side of the toner container 3M with respect to the attachment portion 58 in the depth direction D13, and is a surface that faces the attachment portion 58 when the toner container 3M is attached to the attachment portion 58. It is noted that the depth direction D13 matches the direction in which the toner container 3M is attached to and detached from the attachment portion 58.

The spiral member 95 is rotatably provided in the upper storage portion 71, and as shown in FIG. 10, extends in the depth direction D13 that is perpendicular to the height direction D11. The spiral member 95 is a conveyance member that conveys the unused toner in the storage space 85 toward the attachment portion 58 (see FIG. 4) through the inside of the first conveyance guide portion 94. In addition, the first conveyance guide portion 94 is a guide member that guides the unused toner conveyed by the spiral member 95 to the developing device 33.

As shown in FIG. 10, the spiral member 95 includes blades 97 of a spiral shape around a rotation shaft 96. An end portion 961 (an example of the first end portion) of the rotation shaft 96 of the spiral member 95 on the lid member 76 side is rotatably supported by a bearing portion 99 (an example of the first bearing portion) that is integrally formed with an inner surface 762 of the lid member 76. In addition, in a state where the spiral member 95 is inserted in the first conveyance guide portion 94, the opposite end of the rotation shaft 96 is rotatably supported by the first conveyance guide portion 94. Specifically, a first input portion 98 (an example of the first drive input portion and the second input joint) is integrally formed with an end portion 962 that is the opposite end of the rotation shaft 96, wherein the first input portion 98 receives a rotational driving force input from outside. In addition, a through hole 941 is formed in the tip of the first conveyance guide portion 94. In the state where the first input portion 98 projects from the through hole 941 to the outside, the end portion 962 is rotatably supported by the through hole 941.

A toner discharge port 100 is formed in the lower surface of the first conveyance guide portion 94 so that toner stored in the storage space 85 is discharged from the toner discharge port 100 to the outside.

In addition, on the lower surface of the first conveyance guide portion 94, a shutter member 101 (an example of the opening and closing member) for opening and closing the toner discharge port 100 is provided. The shutter member 101 is supported by the first conveyance guide portion 94 in such a manner that the shutter member 101 can slide the lower surface of the first conveyance guide portion 94 in the longitudinal direction (the left-right direction of FIG. 10) of the first conveyance guide portion 94.

In the present embodiment, when the toner container 3M is attached to the attachment portion 58 (see FIG. 4), the shutter member 101 is moved from a closing position of closing the toner discharge port 100, to an opening position of opening the toner discharge port 100.

In addition, the toner discharge port 100 is aligned with the supply port 56 of the developing device 33 for positioning, then the toner discharge port 100 is connected to the supply port 56 so that toner can be supplied from the toner discharge port 100 to the supply port 56. In addition, the first input portion 98 is coupled with a first output joint 61 (an example of the drive output portion and the first drive coupling portion, see FIG. 13) that is provided in the attachment portion 58, and a rotational driving force output from a drive source such as a motor is transmitted to the first input portion 98. Upon receiving the rotational driving force, the spiral member 95 is rotated, and the toner in the storage space 85 is conveyed from the toner discharge port 100 to the supply port 56 via the first conveyance guide portion 94, and is supplied to the inside of the developing device 33.

As shown in FIG. 13, the first output joint 61 is provided in the attachment portion 58. The first output joint 61 is a drive output portion configured to output the rotational driving force that is output from a drive source such as a motor provided in the image forming apparatus 10, to the outside. The first output joint 61 is coupled with the first input portion 98 in the left-right direction D3 when the toner container 3M is attached to the attachment portion 58.

As shown in FIG. 5 and FIG. 9, a gear transmission mechanism 103 (an example of the transmission mechanism) is provided in the lid member 76. The gear transmission mechanism 103 is coupled with the rotation shaft 96 of the spiral member 95 and with a rotation shaft member 911 of the stirring member 91 in the state where the lid member 76 closes the opening portions 81 and 82. With this configuration, the rotational driving force transmitted from the first input portion 98 to the spiral member 95 is transmitted to the stirring member 91 by the gear transmission mechanism 103. That is, with the provision of the gear transmission mechanism 103, when the rotational driving force is input to the first input portion 98, the spiral member 95 and the stirring member 91 are rotated interlocking with each other.

As shown in FIG. 6, the lower storage portion 72 includes a second conveyance portion 105. Specifically, the second conveyance portion 105 for conveying the waste toner discharged from a drum unit 31 for magenta to the inside of the storage space 86 is provided in the storage space 86. The second conveyance portion 105 includes a second conveyance guide portion 107 and a spiral member 108, wherein the second conveyance guide portion 107 is cylindrical, extends outward from a wall surface 791 of the left side of the lower case 79, and includes a toner conveyance path in its inside, and the spiral member 108 (an example of the second rotating member, the rotating member, and the first conveyance member, see FIG. 11) is provided in the inside of the second conveyance guide portion 107. The second conveyance guide portion 107 is integrally formed with the lower case 79.

The spiral member 108 is rotatably provided in the inside of the lower storage portion 72, and as shown in FIG. 11, extends in the depth direction D13 perpendicular to the height direction D11. The spiral member 108 is a conveyance member that conveys the waste toner that has been discharged from the drum unit 31 to the second conveyance guide portion 107, to the storage space 86 through the inside of the second conveyance guide portion 107. In addition, the second conveyance guide portion 107 is a guide member that receives the waste toner from the drum unit 31, and guides the waste toner conveyed by the spiral member 108 to the inside of the storage space 86.

As shown in FIG. 11, the spiral member 108 includes spiral blades 110 around a rotation shaft 109. An end portion 1091 (an example of the second end portion) of the rotation shaft 109 of the spiral member 108 on the lid member 76 side is rotatably supported by a bearing portion 112 (an example of the second bearing portion) that is integrally formed with the inner surface 762 of the lid member 76. In addition, in a state where the spiral member 108 is inserted in the second conveyance guide portion 107, the opposite end of the rotation shaft 109 is rotatably supported by the second conveyance guide portion 107. Specifically, a second input portion 111 (an example of the second drive input portion and the first input joint) is attached to an opposite end portion 1092 of the rotation shaft 109, wherein the second input portion 111 receives a rotational driving force input from outside.

In addition, a through hole 1071 (an example of the bearing hole and the bearing portion) is formed in the tip of the second conveyance guide portion 107. In the state where the second input portion 111 projects from the through hole 1071 to the outside, the end portion 1092 is rotatably supported in the inside of the second conveyance guide portion 107.

As shown in FIG. 11, the inlet 114 for guiding the waste toner to the inside of the storage space 86 is formed on the upper surface of the second conveyance guide portion 107. In addition, on the upper surface of the second conveyance guide portion 107, a shutter member 115 for opening and closing the inlet 114 is provided. The shutter member 115 is supported by the second conveyance guide portion 107 such that the upper surface of the second conveyance guide portion 107 can be slid in the longitudinal direction (the left-right direction of FIG. 11) of the second conveyance guide portion 107.

In the present embodiment, when the toner container 3M is attached to the attachment portion 58 (see FIG. 4), the shutter member 115 is moved from a closing position of closing the inlet 114, to an opening position of opening the inlet 114.

In addition, the inlet 114 is aligned with the discharge port 431 of the discharge guide portion 43 for positioning, then the inlet 114 is connected to the discharge port 431 so that waste toner can be conveyed from the discharge port 431 to the inlet 114. In addition, the second input portion 111 is coupled with a second output joint 62 (an example of the drive output portion and the first drive coupling portion, see FIG. 13) that is provided in the attachment portion 58, and a rotational driving force output from a drive source such as a motor is transmitted to the second input portion 111. Upon receiving the rotational driving force, the spiral member 108 is rotated, and the waste toner that has been discharged from the discharge port 431 and conveyed into the second conveyance guide portion 107 is conveyed to the storage space 86 through the second conveyance guide portion 107.

As shown in FIG. 13, the second output joint 62 is provided in the attachment portion 58, at a position different from the first output joint 61. The second output joint 62 is a drive output portion configured to output the rotational driving force that is output from a drive source such as a motor provided in the image forming apparatus 10, to the outside. The second output joint 62 is coupled with the second input portion 111 in the left-right direction D3 when the toner container 3M is attached to the attachment portion 58.

As described above, in the present embodiment, the central flange 832 is provided so as to couple the upper case 78 of the upper storage portion 71 with the lower case 79 of the lower storage portion 72. As a result, even if, due to a production error or the like, the first input portion 98 and the second input portion 111 are positionally deviated, or the first output joint 61 and the second output joint 62 are positionally deviated, the toner container 3M can be bent at the vicinity of the gap 88 when the toner container 3M is attached to the attachment portion 58, so that the first input portion 98 is aligned with the first output joint 61, and the second input portion 111 is aligned with the second output joint 62 for positioning. This allows the first input portion 98 to be coupled with the first output joint 61, and the second input portion 111 to be coupled with the second output joint 62, smoothly in a reliable manner. In addition, in a case where the rotational driving force is transmitted in the state where the toner container 3M is attached to the attachment portion 58, even if, due to a positional deviation, a load is applied to the input portions 98 and 111 or the output joints 61 and 62, the load escapes toward the central flange 832 and bends the toner container 3M at the vicinity of the gap 88. With this configuration, it is possible to distribute the load of the input portions 98 and 111 or the output joints 61 and 62 and prevent the input portions 98 and 111 or the output joints 61 and 62 from being damaged.

As shown in FIG. 8, the first conveyance portion 92 and the second conveyance portion 105 are separated from each other in the width direction D12. Specifically, the first conveyance portion 92 is provided on the wall surface 781 of the upper storage portion 71 at a position close to a side portion on one side (the front side) in the width direction D12. In addition, the second conveyance portion 105 is provided on the wall surface 791 of the lower storage portion 72 at a position close to a side portion on the opposite side (the rear side) in the width direction D12.

As shown in FIG. 7 and FIG. 9, the toner container 3M includes a gripping portion 122 having a concave portion 123. The gripping portion 122 is a portion that is gripped by the user when the user carries or performs a replacement of the toner container 3M. In the present embodiment, the concave portion 123 is formed in one side of the container main body 75 in the width direction D12. More specifically, the concave portion 123 is formed between the upper storage portion 71 and the lower storage portion 72 in a side portion on the front side in the attachment attitude of the toner container 3M attached to the attachment portion 58. The concave portion 123 passes through the toner container 3M in the depth direction D13, and when the toner container 3M is viewed from the lid member 76 side, the concave portion 123 is rectangular. With the formation of the concave portion 123, the toner container 3M has the gripping portion 122 that is a narrowed, constricted portion. Since, the gripping portion 122 is formed in a constricted shape so as to be easily held by the user, the user can easily place his/her fingers on the gripping portion 122, easily carry the toner container 3M, and easily perform the replacement work. It is noted that since the lid member 76 is formed in the shape that matches the shape of the container main body 75, the lid member 76 also has a constricted portion in correspondence with the gripping portion 122.

As shown in FIG. 7, the concave portion 123 is provided in an upper portion of the lower storage portion 72. As a result, under the constraint that the toner container 3M cannot be increased in size, the presence of the concave portion 123 reduces the capacity of the storage space 86 of the lower storage portion 72. However, since the lower storage portion 72 is configured to store waste toner, the upper space of the storage space 86 is never filled until the storage space 86 is filled with the waste toner. For this reason, the concave portion 123 is preferably formed in the lower storage portion 72. The upper storage portion 71 is configured to store unused toner. As a result, if the concave portion 123 is formed in the upper storage portion 71, the storage space 85 of the upper storage portion 71 cannot secure a prescribed capacity required to store the unused toner. Thus it is not preferable to form the concave portion 123 in the upper storage portion 71.

In addition, the concave portion 123 is formed in proximity to the first conveyance portion 92, more specifically, directly under the shutter member 101 of the first conveyance portion 92. When the toner container 3M is attached to or detached from the attachment portion 58, the shutter member 101 is opened or closed, and the opening or closing of the shutter member 101 generates a sliding resistance. When performing a replacement work of the toner container 3M, the user feels the sliding resistance as a load. However, the concave portion 123 is provided directly under the shutter member 101. Thus, when performing a replacement work of replacing the toner container 3M by gripping the gripping portion 122, the user can easily apply a force to the gripping portion 122, and can directly transmit a force to the shutter member 101. With this configuration, the workability during the replacement work is improved.

As shown in FIG. 5 and FIG. 9, the toner container 3M includes an identification label 126 that indicates the type of the toner container 3M (for example, the color of the toner, model number or the like). The identification label 126 is a sheet-like member whose rear side is coated with an adhesive such as paste, and characters and/or symbols indicating the type are written on the front side thereof. The identification label 126 is stuck to the surface of the lid member 76. Specifically, the identification label 126 is stuck to a region in an outer surface of the lid member 76 that corresponds to the gripping portion 122. According to conventional toner containers, the container main body 75 or the lid member 76 of the toner container 3M is colored to the color of the toner stored therein so that the type thereof can be identified. On the other hand, in the present embodiment, the identification label 126 is used to make the toner container 3 identifiable. This makes it possible to unify the toner containers 3 for color printing.

As shown in FIG. 12, an IC substrate 64 is mounted on an upper portion of the wall surface 781 of the upper case 78, wherein the IC substrate 64 includes a plurality of contact terminals 67. The upper portion of the wall surface 781 includes a concave recess portion 783 that is recessed from the wall surface 781 by one stage. Specifically, the concave recess portion 783 is formed on the wall surface 781 to continue to the upper end of the wall surface 781. The concave recess portion 783 is lower than the wall surface 781 by one stage. The concave recess portion 783 is formed to extend over the whole region of the upper portion of the wall surface 781 in the width direction D12. The IC substrate 64 is disposed on the concave recess portion 783. More specifically, the IC substrate 64 is disposed at the center of the concave recess portion 783 in the width direction D12.

As shown in FIG. 12, two holes 65 are formed in the IC substrate 64. The two holes 65 are respectively formed at opposite ends of the IC substrate 64 in the width direction D12. In addition, as shown in FIG. 7, the upper case 78 is integrally formed with two bosses 66 that extend vertically from the concave recess portion 783. The two bosses 66 have such a size as to be inserted in the holes 65, and are disposed at positions corresponding to the holes 65. In the state where the bosses 66 are inserted in the holes 65 of the IC substrate 64, the top part of each boss 66 is crushed by a pressure so as to spread. This causes the IC substrate 64 to be fixed to the bosses 66. In addition, as shown in FIG. 11, in the state where the IC substrate 64 is fixed to the concave recess portion 783, a surface 641 of the IC substrate 64 becomes flush with the wall surface 781.

Meanwhile, a substrate such as an IC chip is provided with a plurality of contact terminals that come into contact with contact terminals provided in the image forming apparatus. The plurality of contact terminals include a ground terminal. To prevent an electronic device, such as an IC mounted on the substrate, from being damaged, it is necessary that first a ground terminal of the substrate should contact a ground terminal provided in the image forming apparatus when the toner container is attached to the image forming apparatus. As a result, conventionally, in a configuration where the toner container is attached to the image forming apparatus in a direction parallel to a contact surface of the contact terminal, a ground terminal that is longer in the attachment direction than the other contact terminals is provided on the substrate, or a ground terminal is disposed at a position that is closest to a ground terminal provided in the image forming apparatus. However, when the substrate is commonly used in a plurality of types of toner containers, the plurality of types of toner containers differ from each other in attachment height of the substrate, in attachment position, or in attachment position of contact terminals in the image forming apparatus. As a result, there may be a case where a conventional ground terminal cannot be used commonly in the plurality of types of toner containers.

In the present embodiment, the image forming apparatus 10 and the toner container 3M are configured as described below so that when the toner container 3M is attached to the image forming apparatus 10, first the ground terminals of both contact each other before the other contact terminals contact.

As shown in FIG. 12, five contact terminals 67 (671 to 675) are provided on the surface 641 of the IC substrate 64. In addition, a storage portion (not shown) such as a chip memory or a flash memory is implemented on the rear side of the IC substrate 64. The storage portion stores information related to the toner stored in the toner container 3M. Examples of the information related to the toner include the amount of unused toner stored in the upper storage portion 71, the time when the unused toner was stored, and applicable conditions of the unused toner. It is noted that the storage portion may not be provided in the IC substrate 64. For example, the storage portion may be fixed to a wall surface of the container main body 75 and connected to the contact terminals 67 by cables.

The five contact terminals 67 are, while in contact with a conductive material, electrically conductive with the conductive material and are an example of the fixed terminal. The contact terminals 67 are, for example, electrodes formed from copper foils. When the toner container 3M is attached to the attachment portion 58, three contact terminals 671, 672 and 675 among the five contact terminals 67 come into contact with contact terminals 142 (an example of the elastic terminal) of a terminal unit 140 that is described below.

Among the five contact terminals 67, only three contact terminals 671, 672 and 675 are connected to the storage portion, and the other contact terminals 673 and 674 are not connected to the storage portion. That is, in the image forming apparatus 10, only the three contact terminals 671, 672 and 675 are used for communication with the storage portion. In the present embodiment, the contact terminals 671, 672 and 675 are intensively arranged in one side (the rear side) in the width direction D12 on the surface 641 of the IC substrate 64. With such an arrangement of the contact terminals 671, 672 and 675, even when the user's fingers touch any of the contact terminals 67 of the IC substrate 64 when the user carries the toner container 3M or grips the toner container 3M during a replacement work, there is a less possibility that the user's fingers touch any of the contact terminals 671, 672 and 675 than in a case where the contact terminals 671, 672 and 675 are dispersively arranged on the surface 641 of the IC substrate 64.

Specifically, among the five contact terminals 67, four contact terminals 671 to 674 are arranged in alignment in the width direction D12 on the surface 641. The four contact terminals 671 to 674 are disposed at the center of the surface 641 in the width direction D12, and are disposed at equal intervals in the width direction D12. The contact terminal 671 that is located on the most rear side in the width direction D12 is a ground electrode. That is, the contact terminal 671 is a ground terminal. The contact terminal 671 is connected to the storage portion. In addition, the contact terminal 672 adjacent to the contact terminal 671 is a terminal for use in the PLC (Power Line Communication) in which a power line is also used as a communication line, and is connected to the storage portion. That is, the contact terminal 672 is an electrode that can be used for transmission of a signal, data, and power. The contact terminals 671 and 672 are an example of the second contact terminal. The remaining contact terminals 673 and 674 are unused electrodes and are not connected to the storage portion. In addition, the contact terminals 673 and 674 are covered with an insulating film. In other words, among the four electrodes formed in alignment in the width direction D12, the two contact terminals 671 and 672 remain after two electrodes (the contact terminals 673 and 674) on the other side (the front side) in the width direction D12 are covered with an insulating film. Among the five contact terminals 67, only the contact terminals 673 and 674 are covered with an insulating film so as not to function as electrodes, and the other contact terminals 671, 672 and 675 are not covered with an insulating film and function as electrodes. It is noted that although the present embodiment describes an example case where five contact terminals 67 are provided on the IC substrate 64, the contact terminals 673 and 674 may not be provided on the IC substrate 64. It suffices that at least the contact terminals 671 and 675 are provided.

In addition, the contact terminal 675 (an example of the first contact terminal and the first fixed terminal) is arranged below the four contact terminals 671 to 674. The contact terminal 675 has a larger contact area than the other contact terminals 671 to 674, and is approximately double the size of each of the contact terminals 671 to 674. In addition, the other contact terminals 671 to 674 are vertically long in the height direction D11. On the other hand, the contact terminal 675 is formed in a wide shape elongated in the width direction D12. In the present embodiment, the contact terminal 675 is disposed at a position slightly deviated to the rear side from the center in the width direction D12. In other words, the contact terminal 675 is disposed at a position that is below the contact terminals 672 and 673 and more on the contact terminal 672 side than on the contact terminal 673 side, the contact terminals 672 and 673 being near the center among the four contact terminals 671 to 674. The contact terminal 675 is a ground electrode. That is, the contact terminal 675 is a ground terminal. In the present embodiment, two ground terminals are provided on the surface 641 of the IC substrate 64. On the IC substrate 64, the contact terminal 675 is connected to the contact terminal 671 by the pattern wiring.

In the present embodiment, the toner container 3M is configured such that, when the toner container 3M is attached to the attachment portion 58, first the contact terminal 675 contacts a contact terminal 1425 (see FIG. 14) of a terminal unit 140 that is described below, and then the contact terminals 671 and 672 contact contact terminals 1421 and 1422 that are described below.

As shown in FIG. 13, the attachment portion 58 includes the terminal unit 140. The terminal unit 140 is fixed to the bracket 59 of the attachment portion 58. The terminal unit 140 is provided at a position that is in an upper portion of the bracket 59 and corresponds to the IC substrate 64. On the terminal unit 140, a support base 141 (an example of the terminal support portion) and three contact terminals 142 (1421, 1422 and 1425) are provided.

As shown in FIG. 14, the support base 141 supports the three contact terminals 142. Among the three contact terminals 142 on the support base 141, the contact terminal 1425 is separated from the contact terminals 1421 and 1422 in the up-down direction D1, and the contact terminal 1425 is disposed below the contact terminals 1421 and 1422. Specifically, the support base 141 includes a first support portion 1411 and a second support portion 1412 that is disposed below the first support portion 1411. The two contact terminals 1421 and 1422 are supported by the first support portion 1411, and the contact terminal 1425 is supported by the second support portion 1412.

The three contact terminals 142 are configured to contact the contact terminals 671, 672 and 675 among the contact terminals 67 provided in the toner container 3M so as to be connected therewith in an electrically conductive manner. The three contact terminals 142 are an example of the elastic terminal. The three contact terminals 142 correspond to the contact terminals 671, 672 and 675 respectively on a one-to-one basis, and are arranged at positions so as to face the contact terminals 671, 672 and 675 in the state where the toner container 3M is attached to the attachment portion 58. Each of the contact terminals 142 is formed by bending and deforming a metal wire member that has conductivity, or a metal plate member that has conductivity and is narrow and elongated. Configured as such, the contact terminals 142 have spring property. That is, the contact terminals 142 are formed in such a shape as to elastically deform upon receiving a pressure force.

The first support portion 1411 includes two storage portions 144 in which the two contact terminals 1421 and 1422 are stored respectively. The storage portions 144 are provided in alignment in the front-rear direction D2. That is, the two contact terminals 1421 and 1422 are provided in alignment in the front-rear direction D2. The fixing ends at one side of the contact terminals 1421 and 1422 are fixed to a side wall 1441 that defines the left side of the storage portions 144. The contact terminals 1421 and 1422 are elongated in the up-down direction D1. The other ends at the other side of the contact terminals 1421 and 1422 project from the storage portions 144 rightward (toward the wall surface 781 of the toner container 3M), and include contact portions 146 formed in a bent shape. The contact portions 146 come into contact with the contact terminals 671 and 672.

It is noted that the present embodiment describes an example case where the three contact terminals 142 are provided on the terminal unit 140 at positions where they can contact the contact terminals 671, 672 and 675 of the toner container 3M. However, for example, contact terminals (not shown) having the same shape as the contact terminal 1421 may be provided on the first support portion 1411 at positions corresponding to the contact terminals 673 and 674.

The contact terminal 1421 is configured to contact the contact terminal 671, and is disposed at the rear-most position in the first support portion 1411. In addition, the contact terminal 1422 is configured to contact the contact terminal 672, and is disposed in front of the contact terminals 1421 in the first support portion 1411. The contact terminal 1421 (an example of the second ground terminal) is a ground electrode, namely, a ground terminal. In addition, the contact terminal 1422 is an electrode that is used for the PLC.

The contact terminal 1425 (an example of the first ground terminal) is a ground electrode, namely, a ground terminal. The second support portion 1412 includes a storage portion 145 for storing the contact terminal 1425. The contact terminal 1425 is elongated in the front-rear direction D2. Specifically, a fixing boss 148 for fixing a front end portion of the contact terminal 1425 is provided on the front side of the storage portion 145. In the state where the front end portion of the contact terminal 1425 is fixed, the contact terminal 1425 projects rearward in the front-rear direction D2. The rear side of the contact terminal 1425 projects rightward (toward the wall surface 781 of the toner container 3M) from the storage portion 145, and includes a contact portion 149 formed in a bent shape. The contact portion 149 comes into contact with the contact terminal 675.

In the present embodiment, the projection length of the contact terminal 1425 is longer than the projection length of the contact terminals 1421 and 1422. That is, the contact portion 149 of the contact terminal 1425 is located more on the right side (on the side of the wall surface 781 of the toner container 3M) than the contact portions 146 of the contact terminals 1421 and 1422.

With the provision of the contact terminal 1425 as such, during the attachment process in which the toner container 3M is attached to the attachment portion 58, the contact terminal 675, among the contact terminals 671, 672 and 675, first contacts the contact portion 149 of the contact terminal 1425 before the other contact terminals 671 and 672 contact. With this configuration, noises hardly occur when the contact terminals contact, and it is possible to prevent the data in the storage portion of the IC substrate 64 from being damaged, and prevent the IC substrate 64 itself from being damaged.

In addition, the terminal unit 140 of the present embodiment is configured such that, regardless of the type of the toner container 3M, the contact terminal 675 first contacts the contact portion 149 of the contact terminal 1425 during the attachment process as far as the toner container 3M includes the contact terminal 675 that has a contact surface perpendicular to the attachment direction with respect to the attachment portion 58.

In the following, with reference to FIG. 5, FIG. 6, FIG. 15 and FIG. 17, the configuration of the toner container 3K for black is described. It is noted that, as described above, components of the toner container 3K that are the same as those of the toner container 3M are assigned the same reference signs, and description thereof is omitted. In the following description, "M" is added to the reference signs of the components of the toner container 3M, and "K" is added to the reference signs of the components of the toner container 3K, as necessary.

In the toner container 3K, as in the toner container 3M, the IC substrate 64 is mounted on the upper portion of the wall surface 781 of the upper case 78. However, the toner container 3K differs from the toner container 3M in that a concave recess portion 784 (see FIG. 17) that is different from the concave recess portion 783 is provided on the upper portion of the wall surface 781, and that the IC substrate 64 is provided on the concave recess portion 784. The concave recess portion 784 is lower by one stage than the wall surface 781 of the upper case 78. As shown in FIG. 17, the concave recess portion 784 is formed on the wall surface 781 to continue to the upper end of the wall surface 781. The concave recess portion 784 is formed in an upper portion of the wall surface 781 at a position on one side in the width direction D12, more specifically, on the front side. The IC substrate 64 is disposed on the concave recess portion 784. More specifically, the IC substrate 64 is disposed at the center of the concave recess portion 784 in the width direction D12.

With such an arrangement of the contact terminals 671, 672 and 675, even when the user's fingers touch any of the contact terminals 67 of the IC substrate 64 when the user carries the toner container 3K or grips the toner container 3K during a replacement work, there is a less possibility that the user's fingers touch any of the contact terminals 671, 672 and 675 than in a case where the contact terminals 671, 672 and 675 are dispersively arranged on the surface 641 of the IC substrate 64. In particular, in the toner container 3K, the concave recess portion 784 is formed in one side in the width direction D12 (the front side), and thus the user's fingers are apt to touch the IC substrate 64 when the user grips the toner container 3K. Accordingly, in the case where the concave recess portion 784 is formed at such a position, it is preferable that the contact terminals 671, 672 and 675 are intensively arranged in the rear side opposite to the front side in which the concave recess portion 784 is formed. Such an arrangement further makes it difficult for the user's fingers to touch the contact terminals 671, 672 and 675.

It is noted that, as described above, in the toner container 3K, not only the waste toner discharged from the drum cleaning device 42, but also the waste toner discharged from the belt cleaning device 38 is stored in the lower storage portion 72K. As a result, as described below, the lower storage portion 72K has a larger capacity than the upper storage portion 71K. In the present embodiment, the concave recess portion 784 to which the IC substrate 64 is attached is provided in the upper case 78. This is to prevent a case where the capacity of the lower storage portion 72K is reduced because the storage space 86K is narrowed by the concave recess portion 784 if the concave recess portion 784 is provided in the lower case 79.

In addition, the toner container 3K differs from the toner container 3M in that the toner container 3K is larger in outer shape and capacity than the toner container 3M, that the toner container 3K includes a gripping portion 132 in place of the gripping portion 122, and that two step portions 151 and 152 are formed in the lower storage portion 72K.

As shown in FIG. 5 and FIG. 6, the upper storage portion 71K of the toner container 3K has a larger size in the width direction D12 than the upper storage portion 71M of the toner container 3M. It is noted that they have the same sizes in the height direction D11 and in the depth direction D13. As a result, the storage space 85K of the upper storage portion 71K has a larger capacity and can store a larger amount of unused toner than the storage space 85M of the upper storage portion 71M.

The lower storage portion 72K of the toner container 3K has larger sizes in the height direction D11, the width direction D12 and the depth direction D13 than the lower storage portion 72M of the toner container 3M. As a result, the storage space 86K of the lower storage portion 72K has a larger capacity and can store a larger amount of waste toner than the storage space 86M of the lower storage portion 72M. In particular, since the lower storage portion 72K has larger sizes in the three directions D11, D12 and D13 than the lower storage portion 72M, the storage space 86K of the lower storage portion 72K has a larger capacity than the storage space 86M of the lower storage portion 72M, and has a larger capacity than the storage space 85K of the upper storage portion 71K. That is, in the toner container 3K, the lower storage portion 72K has a larger capacity than the upper storage portion 71K.

Specifically, as shown in FIG. 16, the lower storage portion 72K of the toner container 3K has a larger size in the depth direction D13 than the upper storage portion 71K. That is, the size in the depth direction D13 of the lower storage portion 72K of the toner container 3K is larger than the size in the depth direction D13 of the upper storage portion 71K. In addition, the upper storage portion 71K and the lower storage portion 72K have approximately the same sizes in the height direction D11 and the width direction D12.

With the above-described configuration, both the upper storage portion 71K and the lower storage portion 72K can secure enough capacity. In addition, since the storage space 86K of the lower storage portion 72K has a larger capacity than the storage space 85K of the upper storage portion 71K, the storage space 86K can sufficiently store not only the waste toner from the drum cleaning device 42, but also the waste toner from the belt cleaning device 38.

As shown in FIG. 15 to FIG. 17, the toner container 3K includes the gripping portion 132 that includes a concave portion 133 (an example of the first concave portion) and a concave portion 134 (an example of the second concave portion). The gripping portion 132 is configured to be gripped by the user when the user carries the toner container 3K or performs a replacement of the toner container 3K. In the present embodiment, the concave portion 133 is formed in a side portion of the container main body 75 on one side in the width direction D12. More specifically, the concave portion 133 is formed between the upper storage portion 71 and the lower storage portion 72 in a side portion of the container main body 75 on the front side in the attachment attitude of the toner container 3K attached to the attachment portion 58. In addition, the concave portion 134 is formed in a side portion of the container main body 75 on the other side in the width direction D12. More specifically, the concave portion 134 is formed between the upper storage portion 71 and the lower storage portion 72 in a side portion of the container main body 75 on the rear side in the attachment attitude of the toner container 3K attached to the attachment portion 58. That is, the toner container 3K includes the concave portions 133 and 134 (an example of the pair of concave portions) that are formed to make a pair in side portions of the container main body 75 on opposite sides in the width direction D12.

Each of the concave portions 133 and 134 passes through the toner container 3K in the depth direction D13, and when the toner container 3K is viewed from the lid member 76 side, each of the concave portions 133 and 134 is rectangular. With the formation of the concave portions 133 and 134, in the toner container 3K, a portion formed between the concave portion 133 and the concave portion 134 is narrowed and constricted. The constricted portion is the gripping portion 132. Since, the gripping portion 132 is constricted in such a way as to be easily held by the user, the user can easily place his/her fingers on the gripping portion 132, easily carry the toner container 3K, and easily perform the replacement work. In particular, since the toner container 3K is wider than the toner container 3M, the gripping portion 132 of an easy-to-hold size can be formed by narrowing the container main body 75 from both sides in the width direction D12. It is noted that since the lid member 76 is formed to have a shape that matches the shape of the container main body 75, the lid member 76 also has a constricted portion in correspondence with the gripping portion 132.

In the present embodiment, the concave portion 133 has a larger size than the concave portion 134. Specifically, the concave portion 133 is greater in length in the height direction D11 than the concave portion 134, and the concave portion 133 is greater in length in the width direction D12 than the concave portion 134. As a result, the user can easily place his/her thumb on the concave portion 133, easily carry the toner container 3M, and easily perform the replacement work.

In addition, as shown in FIG. 6, for the same reason described above for the concave portion 123 of the toner container 3M, the concave portions 133 and 134 of the toner container 3K are provided in the upper portion of the lower storage portion 72.

In addition, for the same reason described above for the concave portion 123 of the toner container 3M, in the toner container 3K, the concave portion 133 is formed in proximity to the first conveyance portion 92, more specifically, directly under the shutter member 101 of the first conveyance portion 92. Thus, when replacing the toner container 3K by gripping the gripping portion 132, the user can easily apply a force to the gripping portion 132, and can directly transmit a force to the shutter member 101. With this configuration, the workability during the replacement work is improved.

It is noted that the gripping portion 132 of the toner container 3K is not limited to the one that includes the concave portions 133 and 134. For example, the gripping portion 132 may include only either one of the concave portion 133 and the concave portion 134. In addition, the gripping portion 122 of the toner container 3M may include a pair of concave portions.

As shown in FIG. 15 and FIG. 16, two step portions 151 and 152 are formed in the lower storage portion 72K. The step portions 151 and 152 are formed in a wall surface 791 of the lower case 79 of the lower storage portion 72K. The step portion 151 (an example of the first step portion) is formed in the wall surface 791 at an end on one side in the width direction D12 (the rear side). Specifically, the step portion 151 is formed in the wall surface 791 at a position opposite to the concave portion 133, at an end on the concave portion 134 side. The step portion 151 is formed in the shape of being recessed from the wall surface 791 toward the inside of the lower storage portion 72K. In addition, the bottom surface of the step portion 151 (the surface lower than the wall surface 791) reaches a side surface of the lower case 79 perpendicular to the wall surface 791 (a side surface on the concave portion 134 side). That is, in the wall surface 791, the step portion 151 is formed to be lowered from the wall surface 791 toward the inside, and the depth size of the step portion 151 with respect to the wall surface 791 is, for example, approximately 2 to 3 mm.

In addition, the step portion 152 (an example of the second step portion) is formed in the wall surface 791 at an end on the other side in the width direction D12 (the front side). Specifically, the step portion 152 is formed in the wall surface 791 at an end on one side in the height direction D11 (the down side). The step portion 152 is formed as a portion that is recessed from the wall surface 791 toward the inside of the lower storage portion 72K. In addition, the bottom surface of the step portion 152 (the surface lower than the wall surface 791) reaches a side surface of the lower case 79 perpendicular to the wall surface 791 (a side surface on the concave portion 133 side). That is, in the wall surface 791, the step portion 152 is formed to be lowered from the wall surface 791 toward the inside. The step portion 152 has a larger depth size with respect to the wall surface 791 than the step portion 151, and the depth size of the step portion 152 is, for example, approximately 3.5 to 4.5 mm.

Since the step portions 151 and 152 are formed in the lower storage portion 72K in the above-described manner, the user can easily place his/her hand on the step portion 151 or the step portion 152 when carrying or gripping the toner container 3K, and can easily grip the toner container 3K. In addition, since the IC substrate 64 is not mounted on the lower storage portion 72K, the user tends to grip the lower storage portion 72K. Accordingly, from the view point of providing the user with excellent usability, the step portions 151 and 152 are preferably formed in the lower storage portion 72K. In particular, since the lower storage portion 72K has a large size in the depth direction D13, forming the step portions 151 and 152 with appropriate depths further makes it easy to grip. In addition, the provision of the step portions 151 and 152 enables the user to visually recognize the step portions 151 and 152 as handles.

In particular, the toner container 3K is provided with the above-described step portions 151 and 152 in addition to the gripping portion 132 having the concave portions 133 and 134. As a result, during the replacement work of the toner container 3K, the user can securely hold the toner container 3K by gripping the gripping portion 132 and perform the replacement work in a reliable manner. In addition, when carrying the toner container 3K, in particular, when carrying the toner container 3K removed for replacement, the user can carry the toner container 3K stably by gripping the step portions 151 and 152 of the lower storage portion 72K in which the waste toner is stored.

It is noted that both the step portions 151 and 152 need not necessarily be formed in the lower storage portion 72K. It suffices that the step portion 151 or the step portion 152 is formed in the lower storage portion 72K. In addition, the step portions 151 and 152 may be formed in the lower storage portion 72M of the toner container 3M.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner container configured to store toner in an inside thereof; and an attachment portion configured to support the toner container in an attachable and detachable manner, wherein the toner container includes a plurality of fixed terminals provided on a facing surface that is a side surface located on one side in an attachment and detachment direction of the toner container with respect to the attachment portion, the facing surface facing the attachment portion when the toner container is attached to the attachment portion, the attachment portion includes:

a terminal support portion; and a plurality of elastic terminals provided on the terminal support portion at positions that face the plurality of fixed terminals when the toner container is attached to the attachment portion, configured to elastically contact and electrically connect with the fixed terminals respectively, and including a first ground terminal, the elastic terminals project from the terminal support portion toward the facing surface, toward the one side in the attachment and detachment direction, and the first ground terminal is longer than the other elastic terminals in projection length.

2. The image forming apparatus according to claim 1, wherein among the plurality of fixed terminals, a first fixed terminal that contacts the first ground terminal is elongated in a width direction perpendicular to the attachment and detachment direction, and the other fixed terminals that contact the other elastic terminals are elongated in an up-down direction perpendicular to the attachment and detachment direction, and among the plurality of elastic terminals, the first ground terminal is elongated in the width direction, and the other elastic terminals are elongated in the up-down direction.

3. The image forming apparatus according to claim 2, wherein the first fixed terminal is separated from the other fixed terminals in the up-down direction on the facing surface of a container main body, and the first fixed terminal is disposed in a region that is lower than the other fixed terminals.

4. The image forming apparatus according to claim 2, wherein the first ground terminal is separated from the other elastic terminals in the up-down direction on the terminal support portion, and the first ground terminal is disposed in a region that is lower than the other elastic terminals.

5. The image forming apparatus according to claim 1, wherein the elastic terminals include a second ground terminal that is different from the first ground terminal, and the second ground terminal and the other elastic terminals are disposed in alignment in a width direction perpendicular to the attachment and detachment direction.

6. The image forming apparatus according to claim 5, wherein the other elastic terminals include a terminal for signal or a terminal for power that is disposed in adjacent to the second ground terminal in the width direction perpendicular to the attachment and detachment direction.

7. The image forming apparatus according to claim 1, wherein the toner container includes a substrate attached to the facing surface, and the plurality of fixed terminals are mounted on the substrate, and on a mounting surface of the substrate the fixed terminals are arranged side-by-side on one side in a width direction perpendicular to the attachment and detachment direction.

8. The image forming apparatus according to claim 1, wherein the toner container includes a first toner storage portion and a second toner storage portion, the first toner storage portion being provided in an upper part of the toner container, the second toner storage portion being provided in a lower part of the toner container, below the first toner storage portion, and the fixed terminals are disposed on the first toner storage portion.

9. A toner container supported, in an attachable and detachable manner, by an attachment portion provided in an image forming apparatus, the toner container comprising:

a plurality of fixed terminals provided on a facing surface that is a side surface located on one side in an attachment and detachment direction of the toner container with respect to the attachment portion, the facing surface facing the attachment portion when the toner container is attached to the attachment portion, wherein the attachment portion includes:

a terminal support portion; and a plurality of elastic terminals provided on the terminal support portion at positions that face the plurality of fixed terminals when the toner container is attached to the attachment portion, configured to elastically contact and electrically connect with the fixed terminals respectively, and including a first ground terminal, the elastic terminals project from the terminal support portion toward the facing surface, toward the one side in the attachment and detachment direction, and the first ground terminal is longer than the other elastic terminals in projection length, and during a process in which the toner container is attached to the attachment portion, a first fixed terminal, among the fixed terminals, corresponding to the first ground terminal first contacts the first ground terminal before the other fixed terminals contact.

10. The toner container according to claim 9, wherein among the plurality of fixed terminals, the first fixed terminal that contacts the first ground terminal is elongated in a width direction perpendicular to the attachment and detachment direction, and the other fixed terminals that contact the other elastic terminals are elongated in an up-down direction perpendicular to the attachment and detachment direction.

* * * * *